US008011531B2

(12) United States Patent
Vovan et al.

(10) Patent No.: US 8,011,531 B2
(45) Date of Patent: Sep. 6, 2011

(54) ENHANCED CONTAINER SYSTEM

(75) Inventors: Terry Vovan, Upland, CA (US); Leon D. Rosen, Santa Monica, CA (US)

(73) Assignee: PWP Industries, Vernon, CA (US)

( * ) Notice: Subject to any disclaimer, the term of this patent is extended or adjusted under 35 U.S.C. 154(b) by 0 days.

(21) Appl. No.: 12/658,032

(22) Filed: Feb. 1, 2010

(65) Prior Publication Data

US 2010/0176129 A1 Jul. 15, 2010

Related U.S. Application Data

(63) Continuation-in-part of application No. 12/154,369, filed on May 22, 2008, now Pat. No. 7,661,528, which is a continuation-in-part of application No. 11/998,582, filed on Nov. 30, 2007.

(51) Int. Cl.
*B65D 25/32* (2006.01)
*B65D 6/28* (2006.01)

(52) U.S. Cl. ..... 220/771; 220/4.21; 220/755

(58) Field of Classification Search ..... 220/771, 220/754, 755, 4.21, 4.22, 4.23, 4.24
See application file for complete search history.

(56) References Cited

U.S. PATENT DOCUMENTS

| | | | |
|---|---|---|---|
| 235,278 | A | 12/1880 | Norton |
| 235,279 | A | 12/1880 | Norton |
| 1,312,587 | A | 8/1919 | Sinn et al. |
| 1,515,560 | A | 11/1924 | Elwell |
| 1,579,942 | A | 4/1926 | Jensvold |
| 1,582,429 | A | 4/1926 | Podel |
| 1,619,423 | A | 3/1927 | Korn |
| 1,738,893 | A | 12/1929 | Grady |
| 2,071,266 | A | 2/1937 | Schmidt |
| D156,860 | S | 1/1950 | Zaikaner |
| 2,675,040 | A | 4/1954 | Raun et al. |
| 2,816,682 | A | 12/1957 | Brucker |
| 3,070,251 | A | 12/1962 | Mangravite |
| 3,351,751 | A | 11/1967 | Stube et al. |

(Continued)

FOREIGN PATENT DOCUMENTS

| | | |
|---|---|---|
| CH | 421805 | 4/1967 |

(Continued)

OTHER PUBLICATIONS

European Search Report in EP250665 dated Jun. 4, 2009.

(Continued)

*Primary Examiner* — Anthony Stashick
*Assistant Examiner* — Niki M Eloshway
(74) *Attorney, Agent, or Firm* — Baker Botts LLP

(57) ABSTRACT

Food containers formed of sheet plastic are latchably stackable on one another. Each container has base (14) and lid (16) elements, with one of them having an outer rim part with a pair of long handle sections (80, 82) that can be pivoted up to form a handle assembly for carrying the container. The sections that form handles are formed in the lid element (16) rather than in the base element (14), so a person does not have to contend with long bouncing sections if the person eats a meal out of the base. One of the elements has vertically undercut grooves (50) and the other element has horizontal projections (52) that slide into and along the grooves. The grooved element has vertical passages (120) along which the projections can move vertically until they can slide into and along the grooves.

10 Claims, 23 Drawing Sheets

U.S. PATENT DOCUMENTS 3,371,817 A 3/1968 Gasbarra et al.
D214,391 S 6/1969 Weiss
3,680,745 A 8/1972 Landen
3,690,902 A 9/1972 Dahl
3,833,147 A 9/1974 Borsum et al.
3,844,443 A 10/1974 Cudzik
3,854,582 A 12/1974 Martinelli
3,931,891 A 1/1976 Peppler
4,119,232 A 10/1978 Thornton
4,126,224 A 11/1978 Laauwe et al.
4,128,184 A 12/1978 Northup
4,135,331 A 1/1979 Lamlee
4,158,983 A 6/1979 Amico
4,197,940 A 4/1980 DeRossett
4,279,355 A 7/1981 Schwartz et al.
4,305,180 A 12/1981 Schwartz
4,333,580 A 6/1982 Sweigart, Jr.
4,375,862 A 3/1983 Kurinsky et al.
4,398,688 A 8/1983 Williams
4,434,903 A 3/1984 Cooke
4,473,170 A 9/1984 Ciancimino
4,516,678 A 5/1985 Fotiadis et al.
4,671,263 A 6/1987 Draenert
4,705,163 A 11/1987 James
4,863,058 A 9/1989 Antoni et al.
4,867,303 A 9/1989 Beckerman et al.
4,874,083 A 10/1989 Antoni et al.
4,896,783 A 1/1990 Leoncavallo et al.
4,991,811 A 2/1991 Portnoy
5,027,973 A * 7/1991 Drogos ..... 220/657
5,072,850 A 12/1991 Gagnon et al.
5,154,295 A 10/1992 Stoner
5,207,345 A 5/1993 Stewart et al.
5,232,112 A * 8/1993 Howard ..... 220/212.5
5,273,174 A 12/1993 Fisher
5,287,959 A 2/1994 Hansen et al.
5,320,233 A 6/1994 Welch
D352,000 S 11/1994 Hansen et al.
5,409,128 A 4/1995 Mitchell
5,445,269 A 8/1995 Williams
5,456,379 A 10/1995 Krupa et al.
5,529,202 A 6/1996 Shamis
D371,964 S 7/1996 Krupa
5,542,206 A 8/1996 Lisch
5,605,244 A 2/1997 Bradshaw
5,613,607 A 3/1997 Kalmanides et al.
5,638,976 A 6/1997 Arnold
5,662,233 A 9/1997 Reid
5,671,856 A 9/1997 Lisch
5,711,442 A 1/1998 Kusz
5,810,209 A 9/1998 Foster
5,931,333 A 8/1999 Woodnorth et al.
5,947,318 A 9/1999 Palm
5,975,322 A 11/1999 Reid
6,209,725 B1 4/2001 Chen
6,234,338 B1 5/2001 Searle
6,257,401 B1 7/2001 Mangla et al.
6,302,268 B1 10/2001 Michaeli
6,349,847 B1 2/2002 Mangla et al.
6,595,366 B1 7/2003 Brown
6,662,950 B1 12/2003 Cleaver
6,688,487 B2 2/2004 Oakes et al.
D494,468 S 8/2004 Vovan
6,874,650 B2 4/2005 Welsh et al.
6,880,697 B2 4/2005 Cheng
6,971,521 B2 12/2005 Pinyot
D524,646 S * 7/2006 Hellenbrand et al. ..... D9/756
7,198,169 B2 4/2007 Silk
7,337,914 B2 3/2008 Spindel et al.
7,337,917 B2 3/2008 Kortleven
2002/0017525 A1 2/2002 Searle et al.
2002/0053569 A1 5/2002 Mills et al.
2004/0099548 A1 5/2004 Ito et al.
2005/0161455 A1 7/2005 Studee
2007/0000922 A1 1/2007 Vovan et al.
2007/0051733 A1 3/2007 Franzen
2007/0235457 A1 10/2007 Merey

FOREIGN PATENT DOCUMENTS

EP 0818171 B1 1/1998

OTHER PUBLICATIONS

U.S. Appl. No. 12/154,369, Mar. 17, 2009 Non-Final Office Action.
U.S. Appl. No. 12/154,369, Jun. 5, 2009 Response to Non-Final Office Action.
U.S. Appl. No. 12/154,369, Oct. 19, 2009 Final Office Action.
U.S. Appl. No. 12/154,369, Dec. 4, 2009 Respnse to Final Office Action.
U.S. Appl. No. 12/154,369, Dec. 18, 2009 Amendment After Final Entered.
U.S. Appl. No. 12/154,369, Dec. 18, 2009 Notice of Allowance.
U.S. Appl. No. 10/645,893, Oct. 11, 2006 Non-Final Office Action.
U.S. Appl. No. 10/645,893, Jan. 16, 2007 Response to Non-Final Office Action.
U.S. Appl. No. 10/645,893, Mar. 5, 2007 Final Office Action.
U.S. Appl. No. 10/645,893, Jun. 7, 2007 Response to Final Office Action.
U.S. Appl. No. 10/645,893, Jun. 11, 2007 Notice of Appeal Filed.
U.S. Appl. No. 10/645,893, Jun. 21, 2007 Amendment After Final Entered.
U.S. Appl. No. 10/645,893, Jun. 21, 2007 Advisory Action.
U.S. Appl. No. 10/645,893, Jul. 30, 2007 Appeal Brief Filed.
U.S. Appl. No. 10/645,893, Aug. 29, 2007 Notice of non-compliant amendment.
U.S. Appl. No. 10/645,893, Mar. 7, 2008 Appeal Brief Filed.
U.S. Appl. No. 10/645,893, May 29, 2008 Non-Final Office Action.
U.S. Appl. No. 10/645,893, Aug. 29, 2008 Response to Non-Final Office Action.
U.S. Appl. No. 10/645,893, Dec. 15, 2008 Final Office Action.
U.S. Appl. No. 10/645,893, Mar. 20, 2009 Notice of Appeal Filed.
U.S. Appl. No. 10/645,893, Mar. 20, 2009 Appeal Brief Filed.
U.S. Appl. No. 10/645,893, May 3, 2009 Appeal Brief Filed.
U.S. Appl. No. 10/645,893, Aug. 14, 2009 Examiner's Answer to Appeal Brief.
U.S. Appl. No. 10/645,893, Sep. 10, 2009 Reply Brief Filed.
U.S. Appl. No. 10/645,893, Nov. 16, 2009 Reply Brief Noted.
U.S. Appl. No. 12/658,032, Aug. 26, 2010 Non-Final Office Action.
U.S. Appl. No. 12/658,032, Nov. 24, 2010 Response to Non-Final Office Action.
U.S. Appl. No. 11/998,582, Dec. 17, 2007 Preliminary Amendment.
U.S. Appl. No. 11/998,582, Sep. 25, 2009 Preliminary Amendment.
U.S. Appl. No. 11/998,582, Feb. 18, 2011—Non-Final Office Action.
U.S. Appl. No. 12/328,686 (previously cited), filed Dec. 4, 2008.
U.S. Appl. No. 10/645,893 (previously cited), filed Aug. 18, 2003.
U.S. Appl. No. 11/998,582 (previously cited), filed Nov. 30, 2007.
U.S. Appl. No. 12/328,686, May 27, 2011, Non-Final Office Action.
U.S. Appl. No. 11/998,582, Jun. 27, 2011, Notice of Allowance.

* cited by examiner

FIG. 10
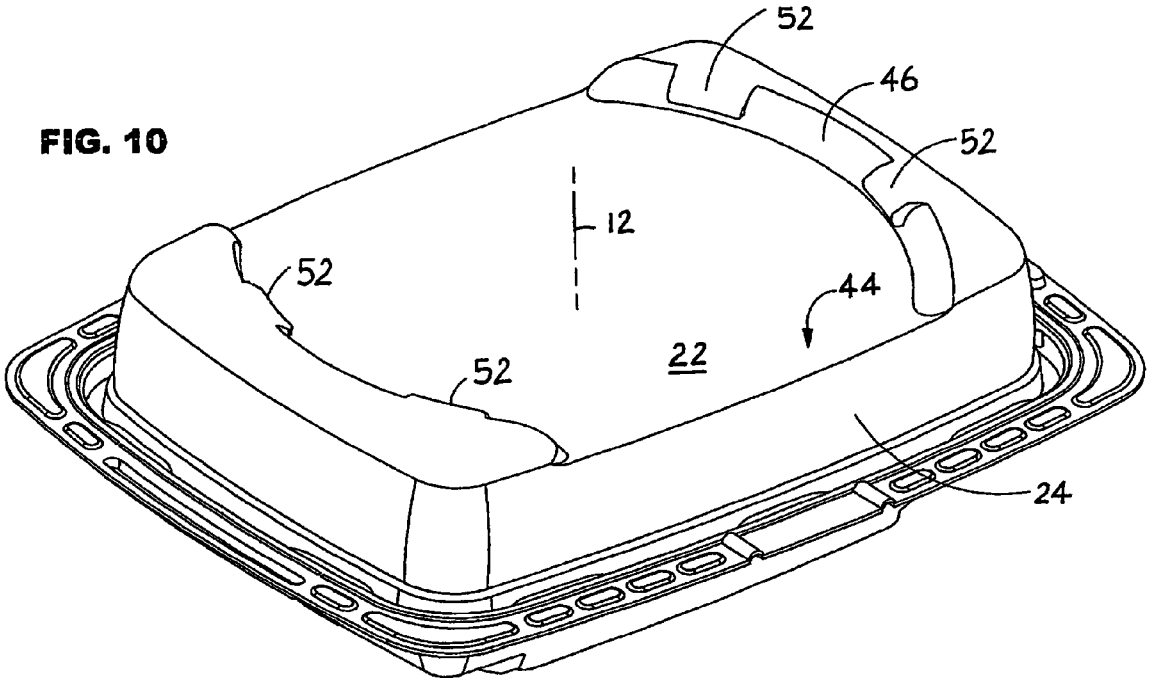
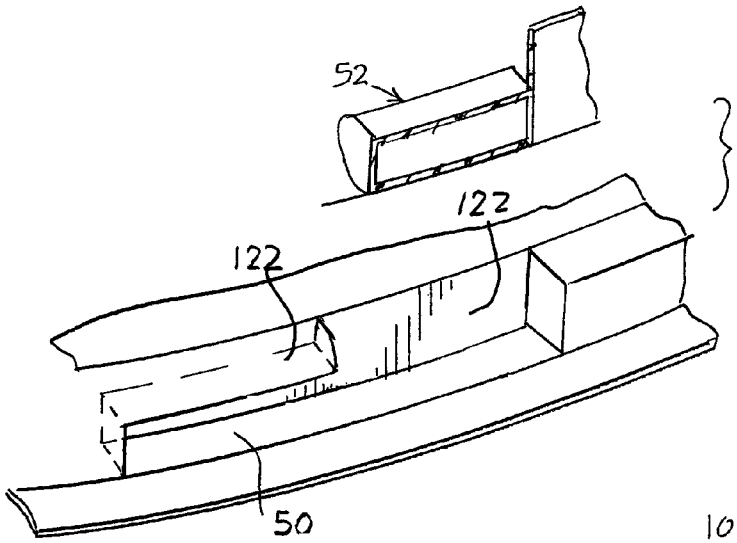
FIG. 11
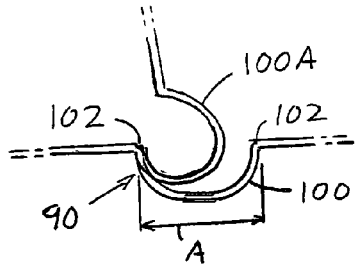
FIG. 11A

ENHANCED CONTAINER SYSTEM

CROSS-REFERENCE

This is a Continuation-in-part of U.S. patent application Ser. No. 12/154,369 filed May 22, 2008 now U.S. Pat. No. 7,661,528 which is a continuation-in-part of U.S. patent application Ser. No. 11/998,582 filed Nov. 30, 2007.

BACKGROUND OF THE INVENTION

Food containers commonly have a base with a food-holding cavity and a lid, with each constructed of a thin deformed plastic sheet, or plastic sheeting. The closed container can be easily carried by forming the rim portion of the base with elongated outer sections that each extends almost halfway around the rim. The outer sections extend between pivot joints that lie at opposite sides of the rim, and the outer sections can be pivoted up to form a handle assembly. U.S. Pat. Nos. 6,257,401 and 6,349,847 show such handles formed in the base of a plastic sheet container. One problem encountered with such handles is that after they have been used once, the long outer sections that form the handles constitute parts that repeatedly move, or "wave" up and down. If a person wishes to eat from the base, the waving handles can be disturbing. A food container with handles, which avoided a base with waving or dangling handles, would be of value.

It is often desirable to stack two or more closed containers on one another. If a higher container of the stack is accidentally lifted slightly and shifted to one side so it is not centered on the lowest container, the stack may collapse. It would be desirable to stack closed containers so they cannot be accidentally removed from the stack.

SUMMARY OF THE INVENTION

In accordance with one embodiment of the invention, a food container is provided with a handle assembly that does not interfere with eating out of the base, and wherein a plurality of identical food containers can be latchably stacked so containers in the stack cannot be individually lifted and shifted by accident. The handles are formed in the lid rather than the base, so long sections of the outer rim that form the handles are not present on the base and do not disturb a person eating out of the base. Latchable stacking is provided by forming one of the elements of the base and lid elements with a plurality of vertically undercut grooves, and forming the other element with a plurality of horizontal projections. The projections can enter and slide along one of the grooves by turning or linearly sliding one element relative to the other, or even by forcefully pushing down the lid onto the base.

In a stack of two containers, the top wall of the lid element of the lower container has a large upward protuberance with opposite vertical end walls that are curved about the vertical axis of the container. The base element of the higher container has a bottom wall with a large upward receptacle having opposite vertical end walls that are also curved about the vertical axis, so the lid protuberance can fit in and turn in the upward receptacle. Horizontal projections of the base element fit into vertically undercut grooves in the protuberance to latch the containers together. The protuberance also has vertical passages through which the projections move down to reach the grooves, and through which the receptacles move out of the grooves to separate the containers. The containers can be latchably stacked by merely forcibly pushing down the upper container against the lower one, so the projections are forced down into the grooves.

Instead of using a protuberance that is circularly curved about the container axis, the lid element can be formed with horizontally-extending, linearly elongated grooves, and the base element can be formed with projections that enter and slide along the grooves by moving the lid element along one of the linear directions.

The novel features of the invention are set forth with particularity in the appended claims. The invention will be best understood from the following description when read in conjunction with the accompanying drawings.

DESCRIPTION OF THE DRAWINGS

FIG. 10 is an isometric view of the base element of the container of FIG. 1, shown in an upside-down position.

FIG. 11 is a partial isometric view showing how a projection of the base element of an upper container, can move vertically though the vertical passage of the lid element of a lower container to enter of leave a vertically undercut groove of the lid element.

FIG. 11A shows the manner of bending of a pivot joint of the container of FIG. 7.

DESCRIPTION OF THE PREFERRED EMBODIMENTS

Figure 1:
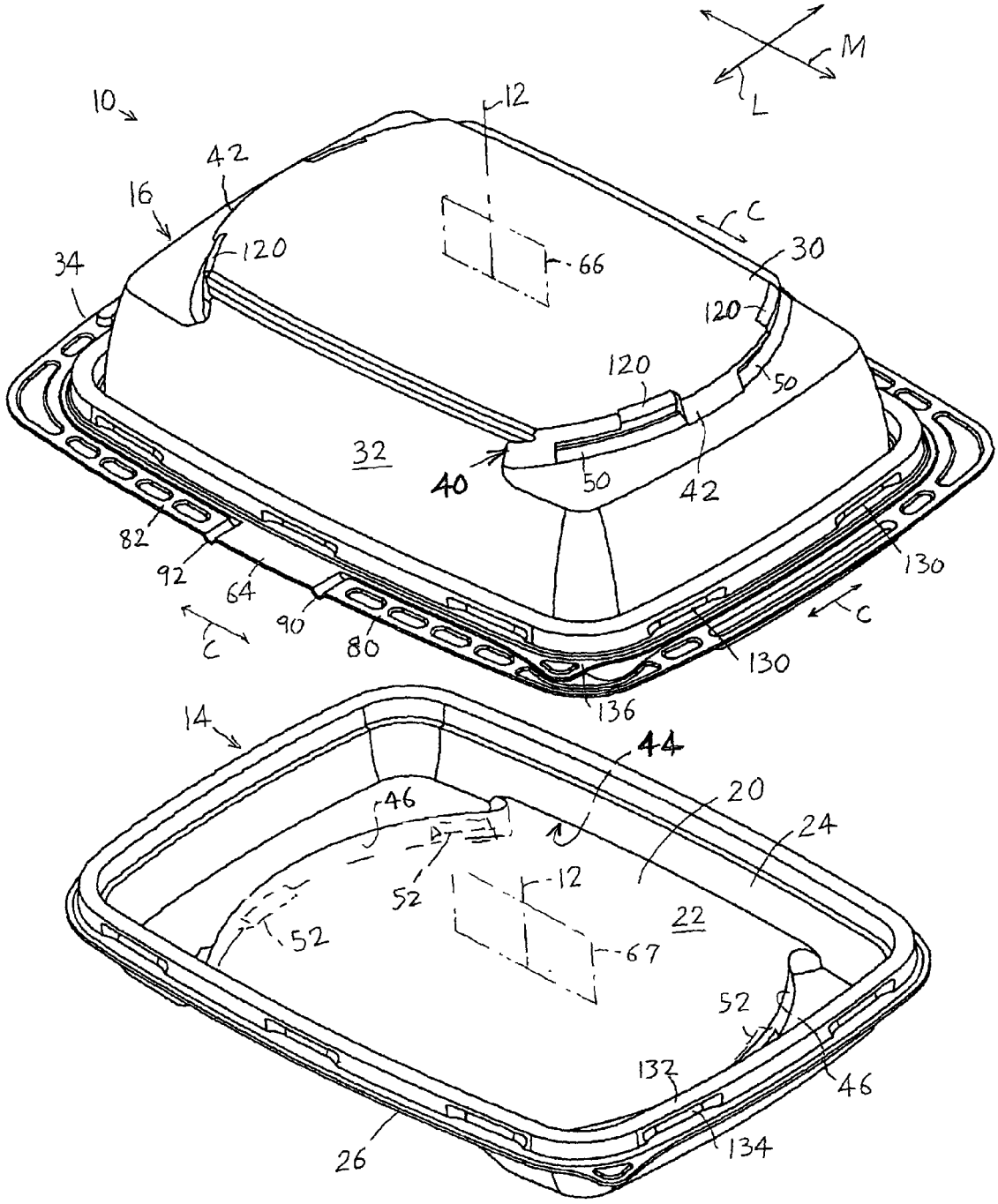
FIG. 1 is an exploded top isometric view of a rectangular container of the invention.

FIG. 1 shows a container 10 that has a vertical axis 12 and that has a base element 14 and a lid, or cover element 16. The base element or base 14 has a base cavity 20 for holding food, and includes a base stacking bottom wall 22, base side walls 24 that extend generally upward from the bottom wall, and a base rim portion 26 at the top of the side walls. The cover element or cover has a top stacking wall 30, side walls 32 that extend generally downward from the top wall, and a cover rim portion 34 that extends around the bottom of the side walls. The cover top wall 30 includes a large upward protrusion 40 with end walls 42 that are curved about the container vertical axis 12. The base bottom wall has a large upward receptacle 44 with end walls 46 that are also curved about the vertical axis 12. This allows the protrusion 40 of a lower container of a stack, to fit partially into a receptacle of a next higher container and turn about the axis 12. The protrusion and receptacle are large in that each has a length in a longitudinal direction M that is at least half the length of the container, and each has a width in a lateral direction L that is at least half the width of the container. The protrusion end walls 42 have grooves 50, and the receptacle end walls 46 have horizontal projections 52 for sliding into and along the grooves in the course of latchably stacking two identical containers 10. The grooves are shown as part of a circle but they could be part of a helix (thread).

Figure 2:
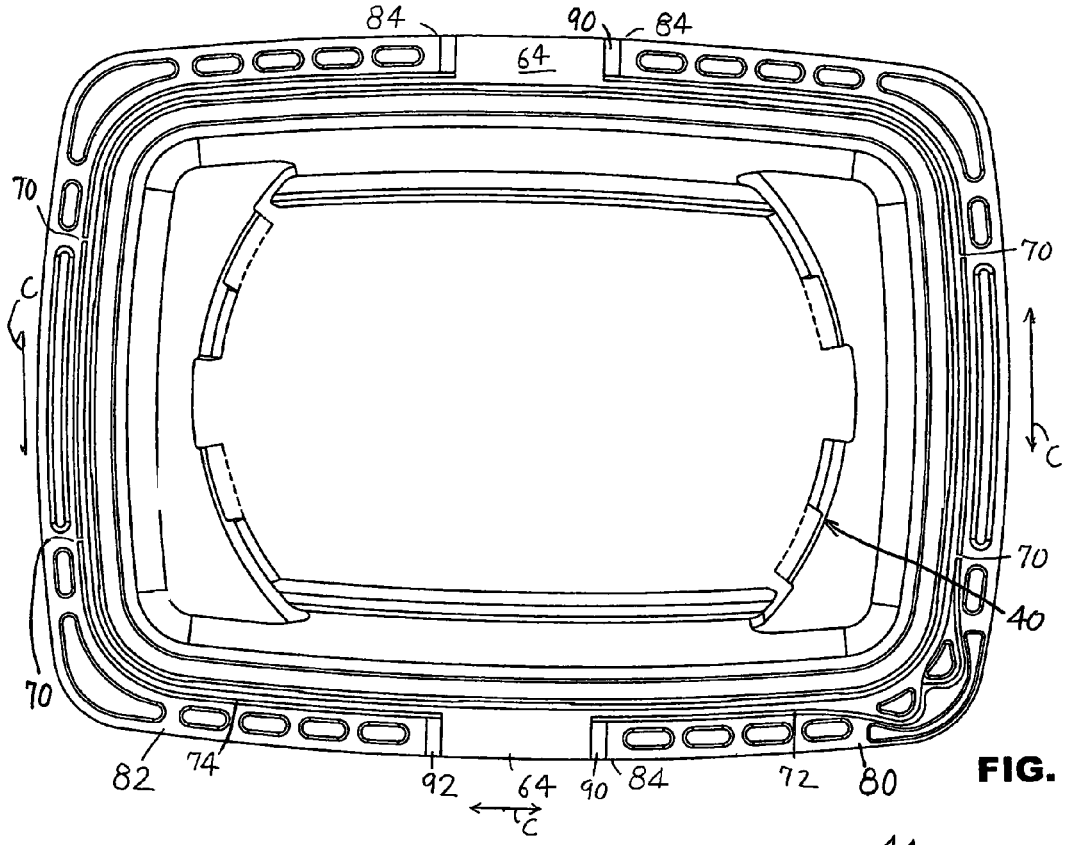
FIG. 2 is a top view of the container of FIG. 1.
Figure 7:
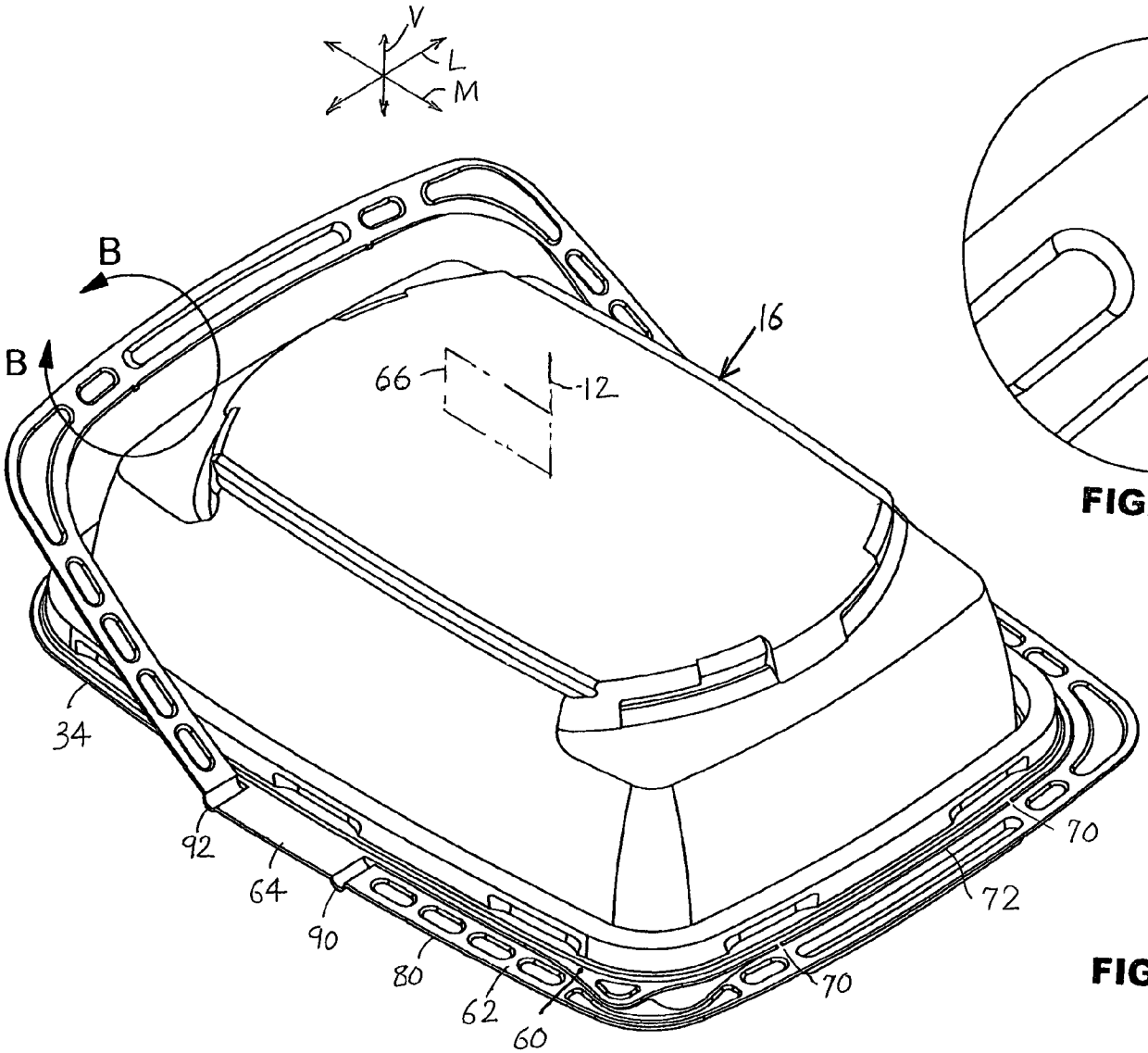
FIG. 7 is an isometric view of the cover of the container of FIG. 1 with the handle assembly deployed.

FIG. 7 shows only the container cover 16, showing that the cover rim portion 34 includes inner and outer rim parts 60, 62, with the inner part 60 lying closest to the container axis 12. The rim parts are connected by a pair of connectors 64 that lie at laterally L opposite sides of the cover. The cover is symmetrical about a longitudinally M and vertical V extending plane 66. FIG. 2 shows that except at the connectors 64 and at short interruptions 70, the inner and outer rim parts are separated by separation lines 72, 74 that are each in the form of a continuous slit that extends completely though the plastic of the cover. The separation lines form the rim outer part into a pair of handle sections 80, 82. Each handle section of the outer rim part, such as 80 extends circumferentially C almost halfway around the container axis, and has opposite ends 84 that each connects to a connector at a corresponding pivot joint 90, 92.

Figure 8:
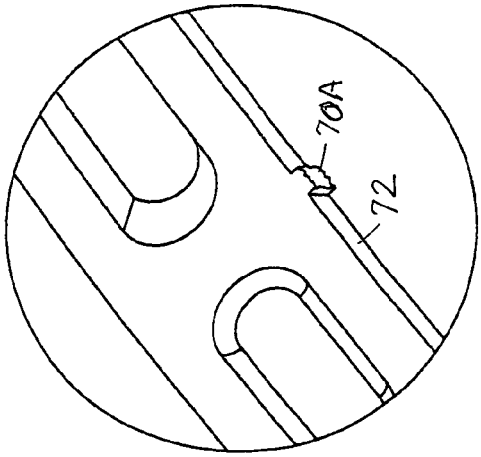
FIG. 8 is a view of area B-B of FIG. 7.
Figure 9:
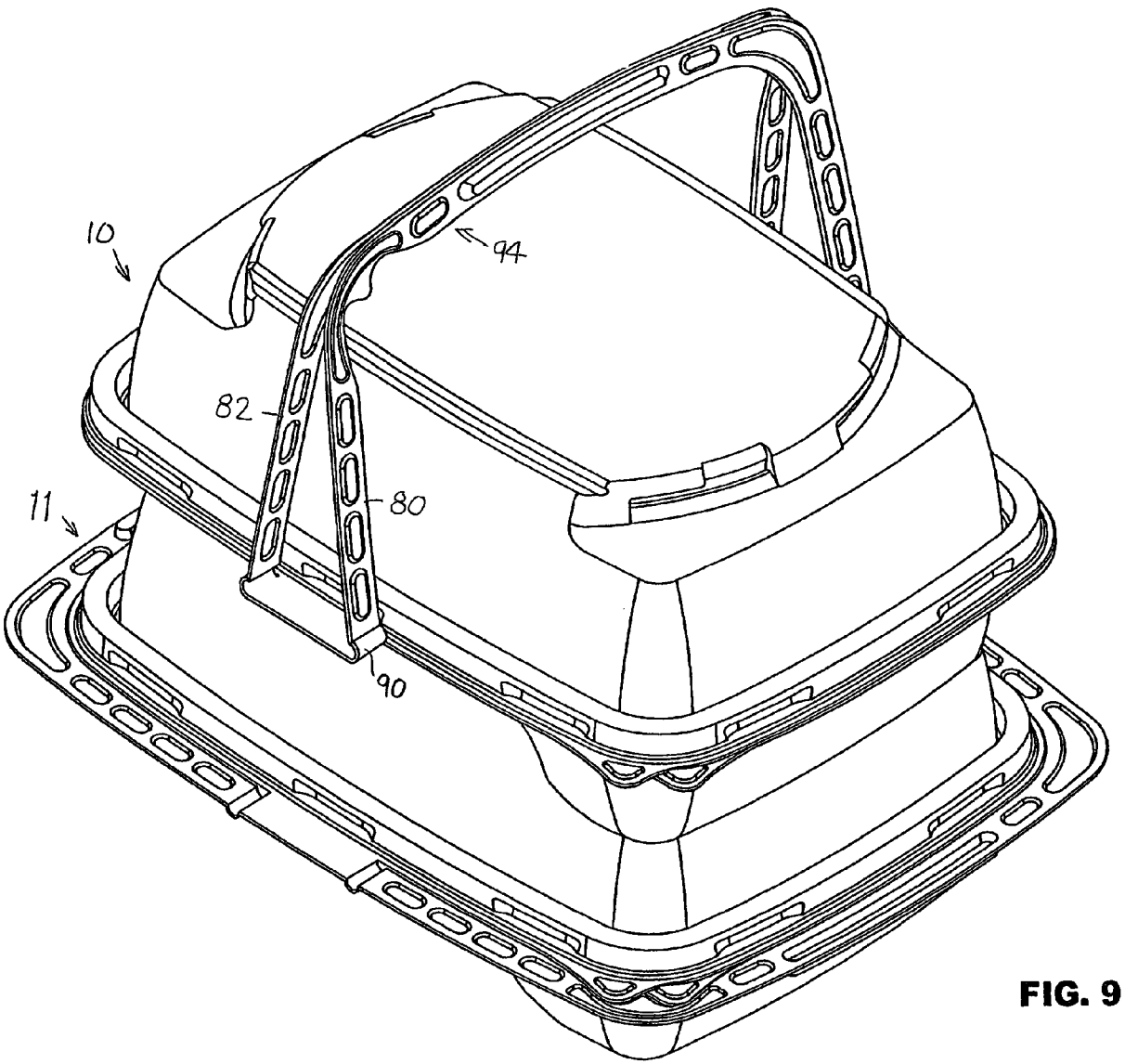
FIG. 9 is an isometric view of the stack of containers of FIG. 5, with the handle deployed.
Figure 12:
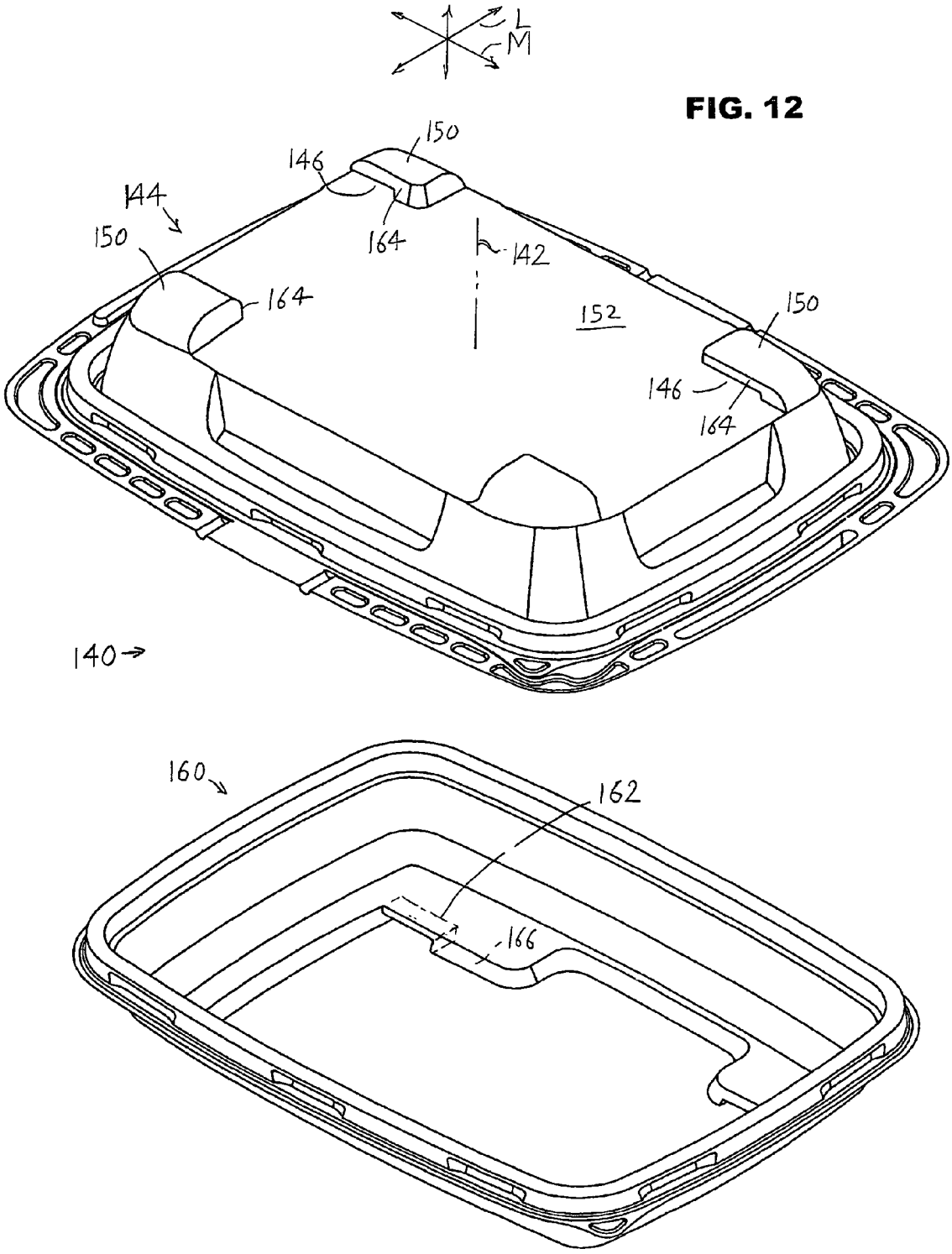
FIG. 12 is an exploded isometric view of a container of another embodiment of the invention, wherein containers can be latchably stacked by sliding one container linearly in a horizontal direction relative to another container.
Figure 13:
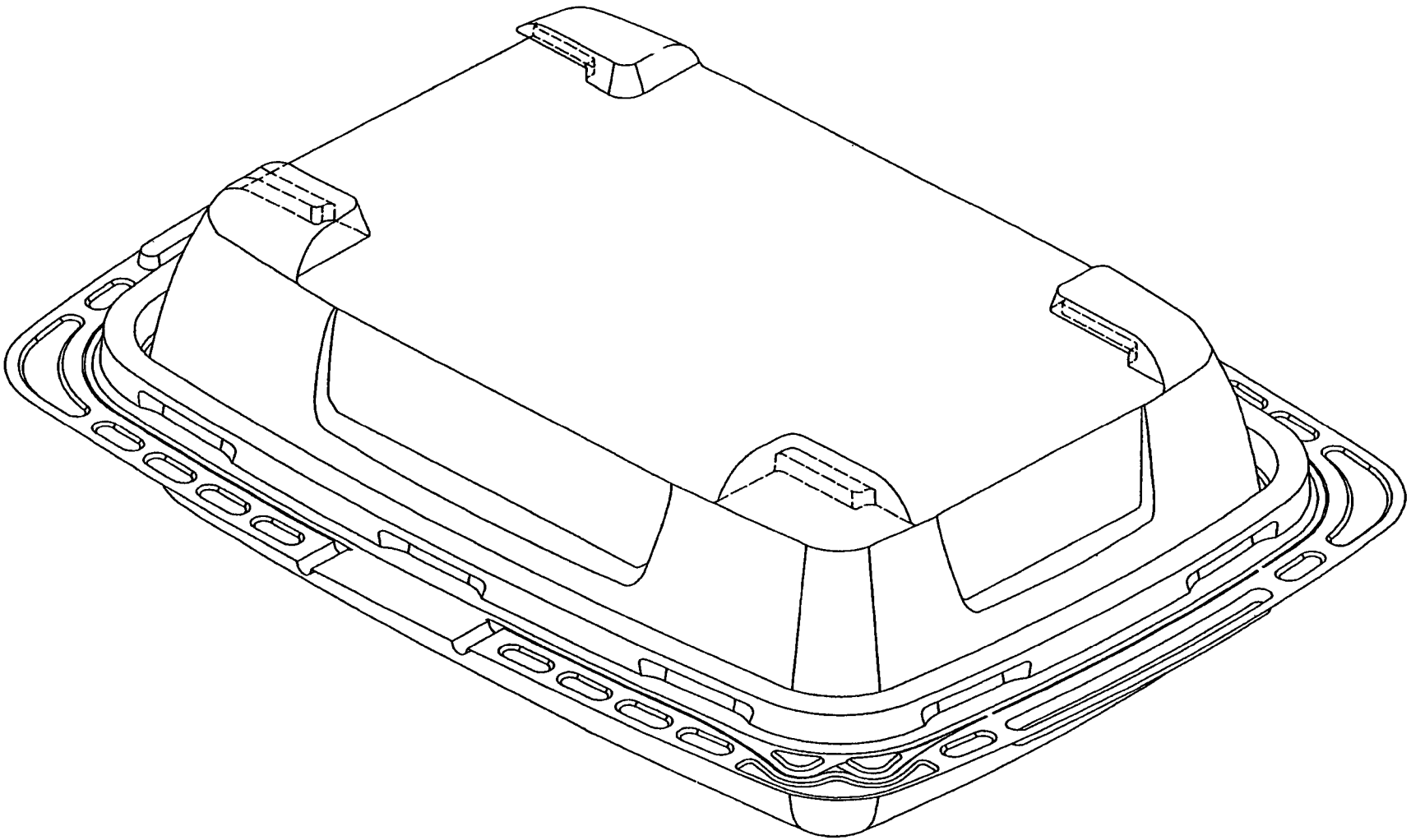
FIG. 13 is an isometric view of the closed container of FIG. 12, with the grooves shown in hidden lines.
Figure 14:
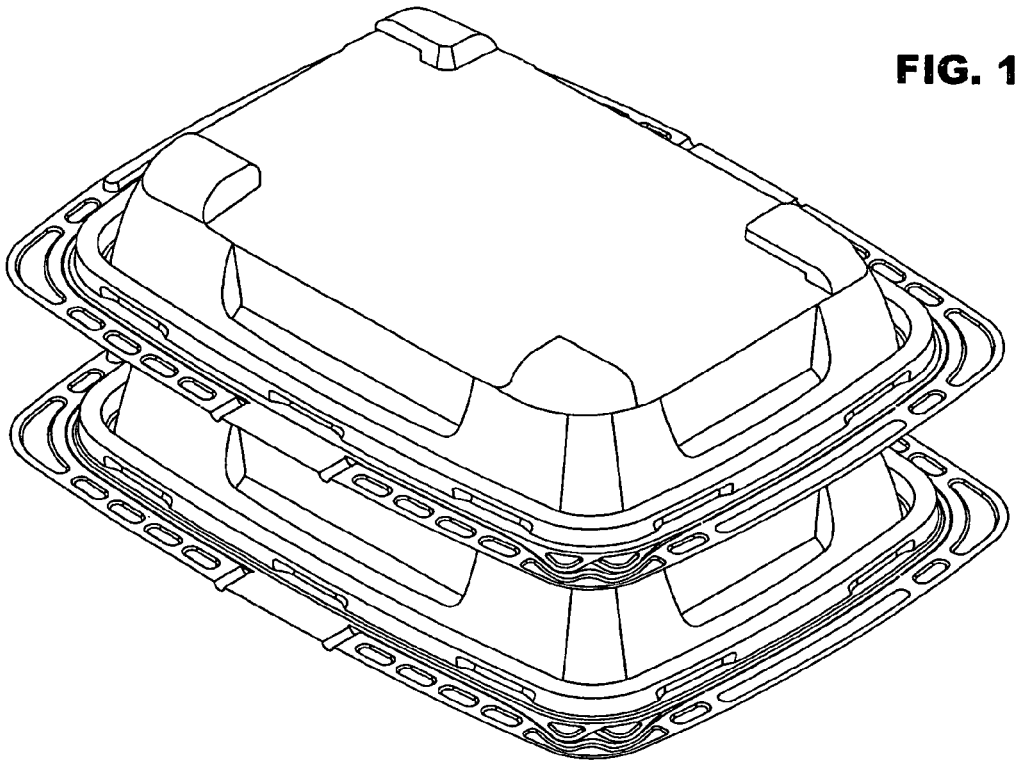
FIG. 14 is an isometric view of a pair of containers each of the construction of FIG. 13, that have been stacked.
Figure 15:
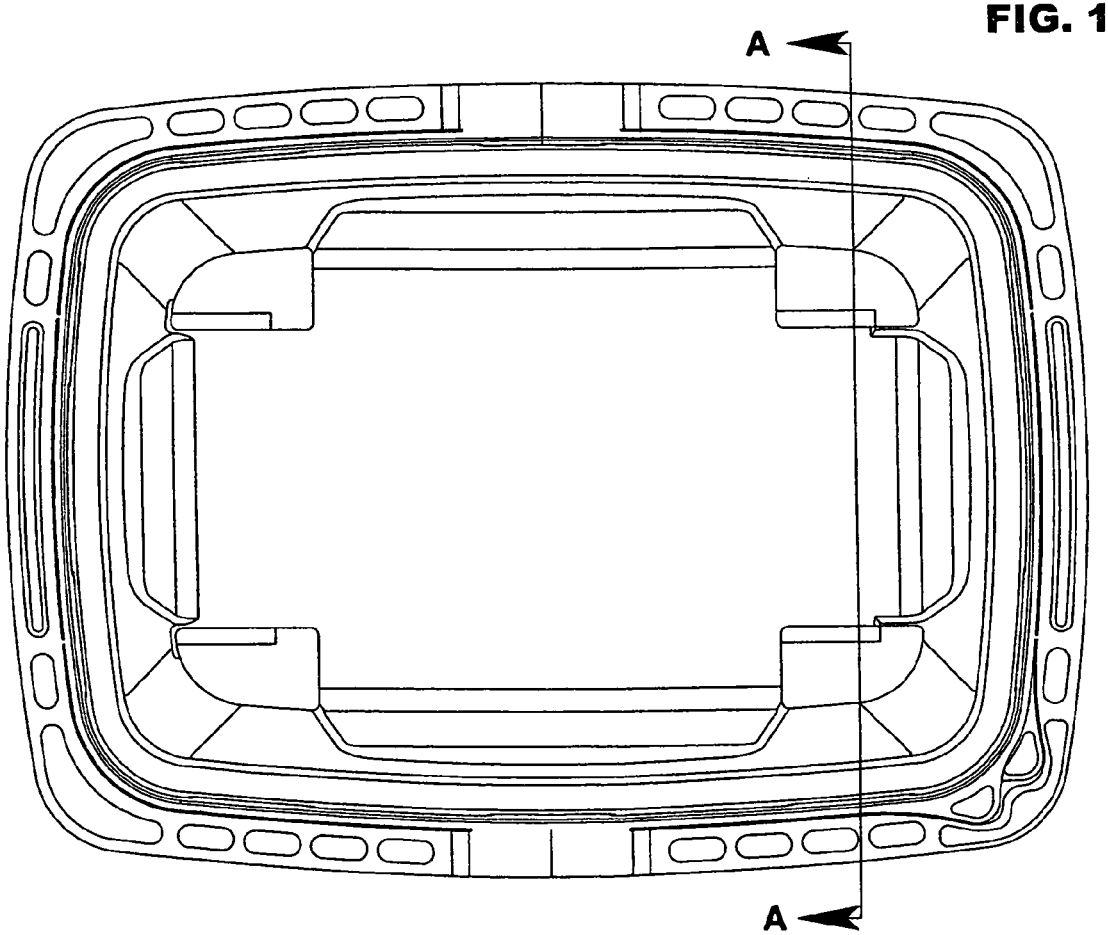
FIG. 15 is a plan view of the stack of FIG. 14.

FIG. 7 shows that each handle section can be freed from the inner rim part by breaking the corresponding pair of interruptions 70, so the handle sections can be pivoted up on a corresponding pivot joint 90, 92. FIG. 9 shows a pair of handle sections 80, 82 pivoted up and joined to form a handle assembly 94 that allows the container, and possibly a stack of containers, to be easily carried. The short pair of interruptions 70 (there are one to ten interruptions per handle sections) for each handle part or section, leave only small irregularities 70A (FIG. 8). In the prior art, the entire separation line was initially cut through. As a result, the handle sections might "wave" up and down in an annoying manner. The short interruption 70 hold the handles in position until they are torn loose to allow the handles to be pivoted up. The separation lines 72, 74 are through slits formed to avoid sharp edges.

FIG. 9 shows a stack of containers with the upper container 10 latchably stacked to a lower container device 11.

In the prior art, handles somewhat similar to what is shown at 80 and 82 in FIG. 9 were provided, that were formed from an outer part of the base of the container, rather than from the cover. This would appear practical because that way the base cannot fall down from the cover when the handles hold the base of the container. However, it is found that the base is commonly used as a dish from which a person eats food from the base cavity. Of course, handles that were used to carry the container home are detached from each other, and the cover is lifted off and set aside. As a person eats from a prior base cavity, the eater notices that the handles such as 80, 82 move up and down with the least touching or vibrations. This is due to the handles being long and formed of thin plastic (e.g. 0.3 to 1 millimeter). Applicant avoids such disturbances by forming the handles in the cover, and by providing a robust connection between the base and cover.

FIG. 7 shows two of the pivot joints 90, 92 that join an end of a handle section such as 80 with the end of a connector 64. Each pivot joint includes a considerable length (at least 2 millimeters) of the plastic connector along which the separation line such as 72 extends. As shown in FIG. 11A, each pivot joint includes a downward extending loop 100 with opposite ends 102 that extend downward and with a horizontal middle. In FIG. 11A the joint has a length A of 5 millimeters, which is more than four times the plastic thickness (0.4 mm). As a result, pivoting of more than 60° occurs by bending along the length of the loop as to 100A rather than by bending at a single location which can lead to fatigue failure, to thereby increase the reliability of the joints.

Figure 3:
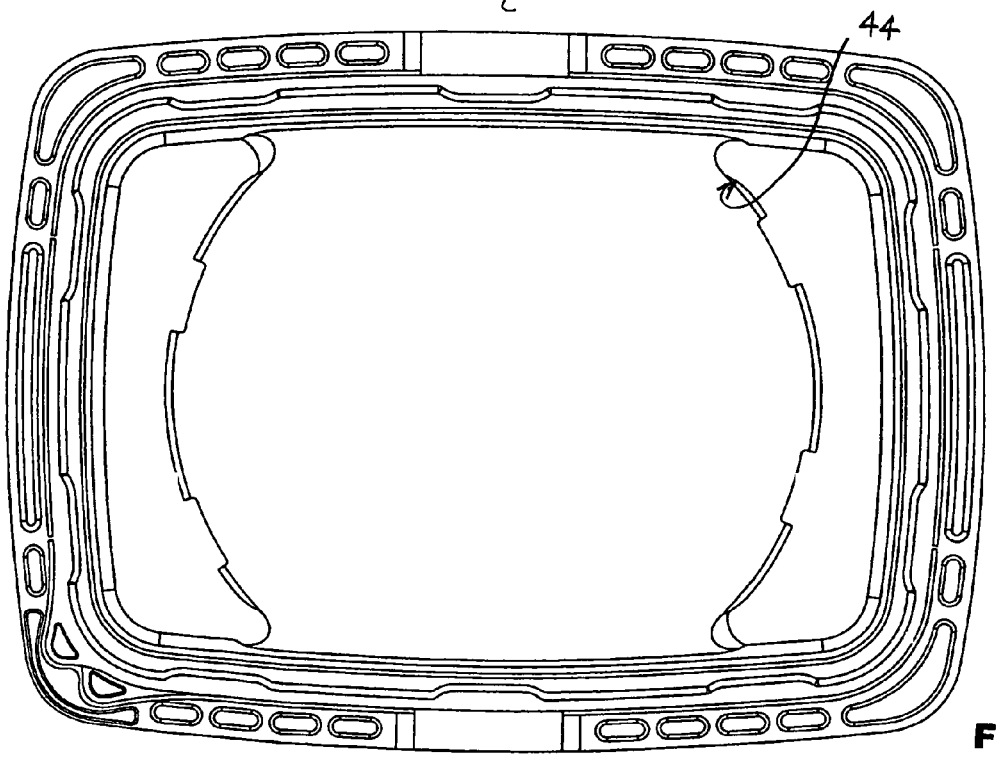
FIG. 3 is a bottom view of the container of FIG. 1.
Figure 4:
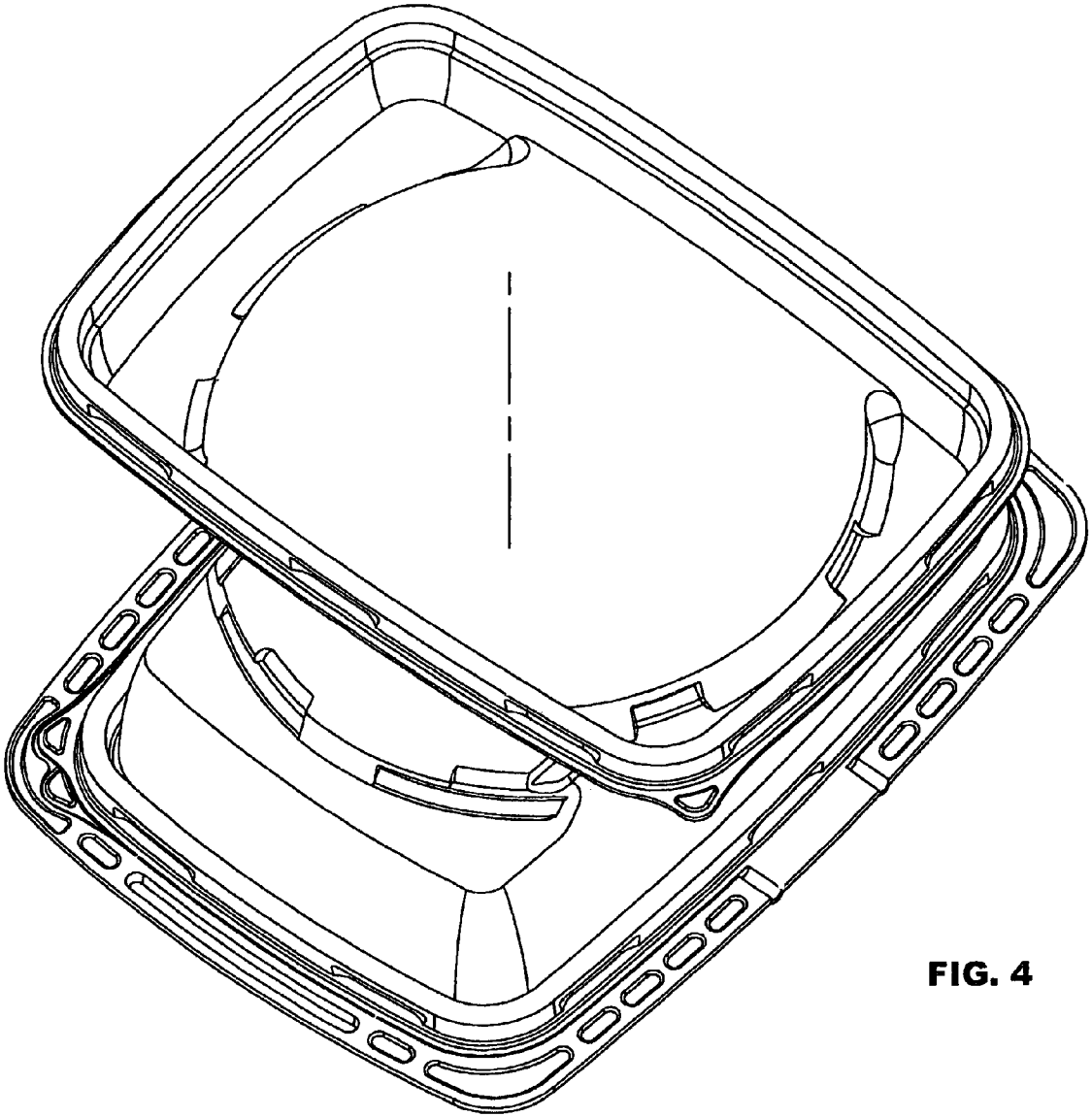
FIG. 4 is an exploded isometric view showing the base element of an upper container being readied to latchably stack to the lid element of a lower container.
Figure 5:
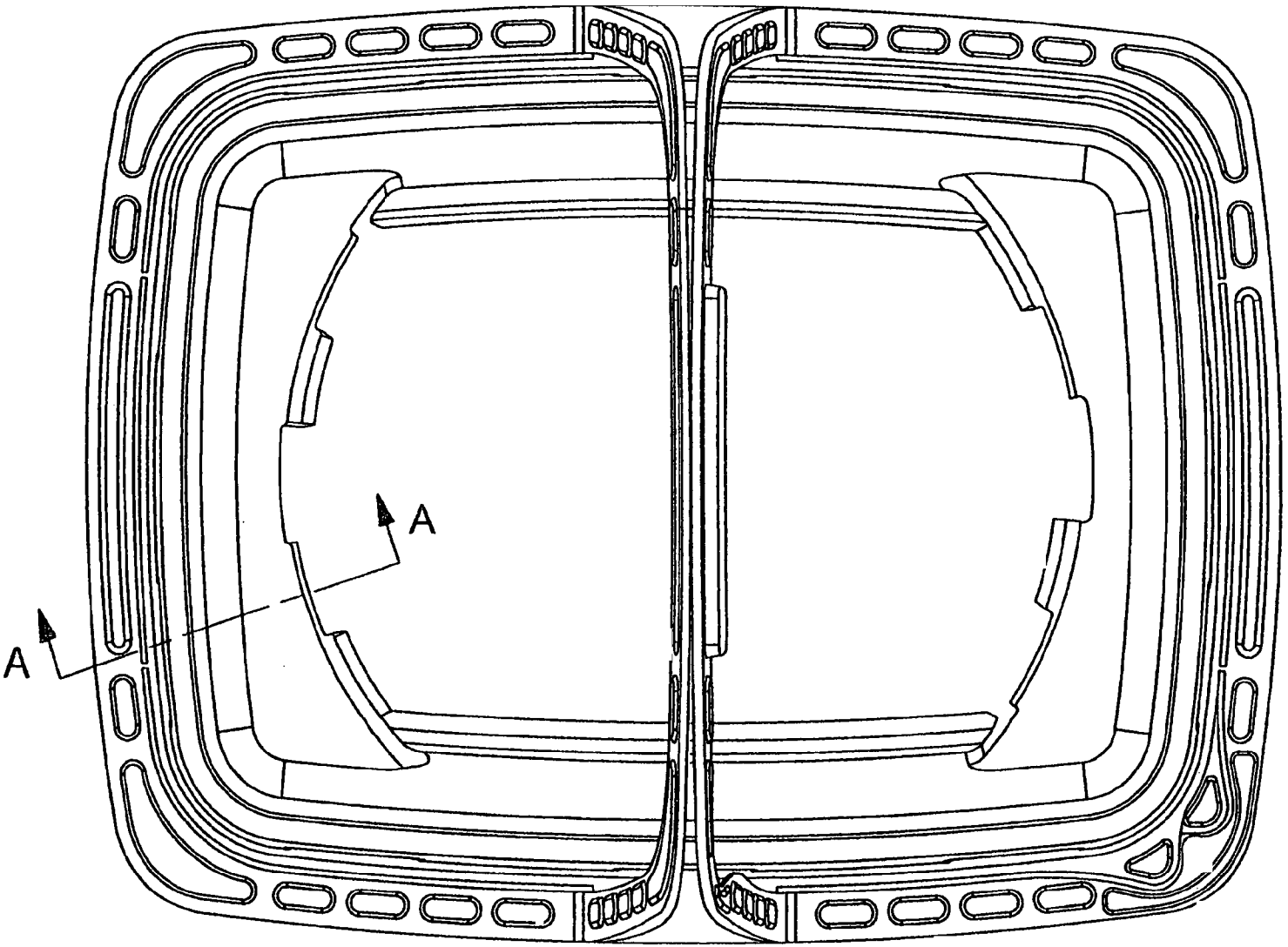
FIG. 5 is a plan view of a stack of containers with the handle assembly of the topmost container deployed to carry the stack.

FIG. 3 shows that each connector 64 has a length J which is a small fraction of the length K between handle middles 80*m*, 82*m*. The length K is the distance between handles middles in the initial position of the handle sections wherein the handle sections lie in a horizontal plane and have not been raised. In particular the ratio J/K is 16.2% for the container of FIG. 3. The small ratio results in the handle middles 80*m*, 82*m* (FIG. 9) extending high above the connectors 64, and therefore considerably above the container top wall 30. This provides sufficient room for a person's hand that grasps the handle ends. The ratio J/K is preferably less than 25% and more preferably less than 20%.

Figure 6:
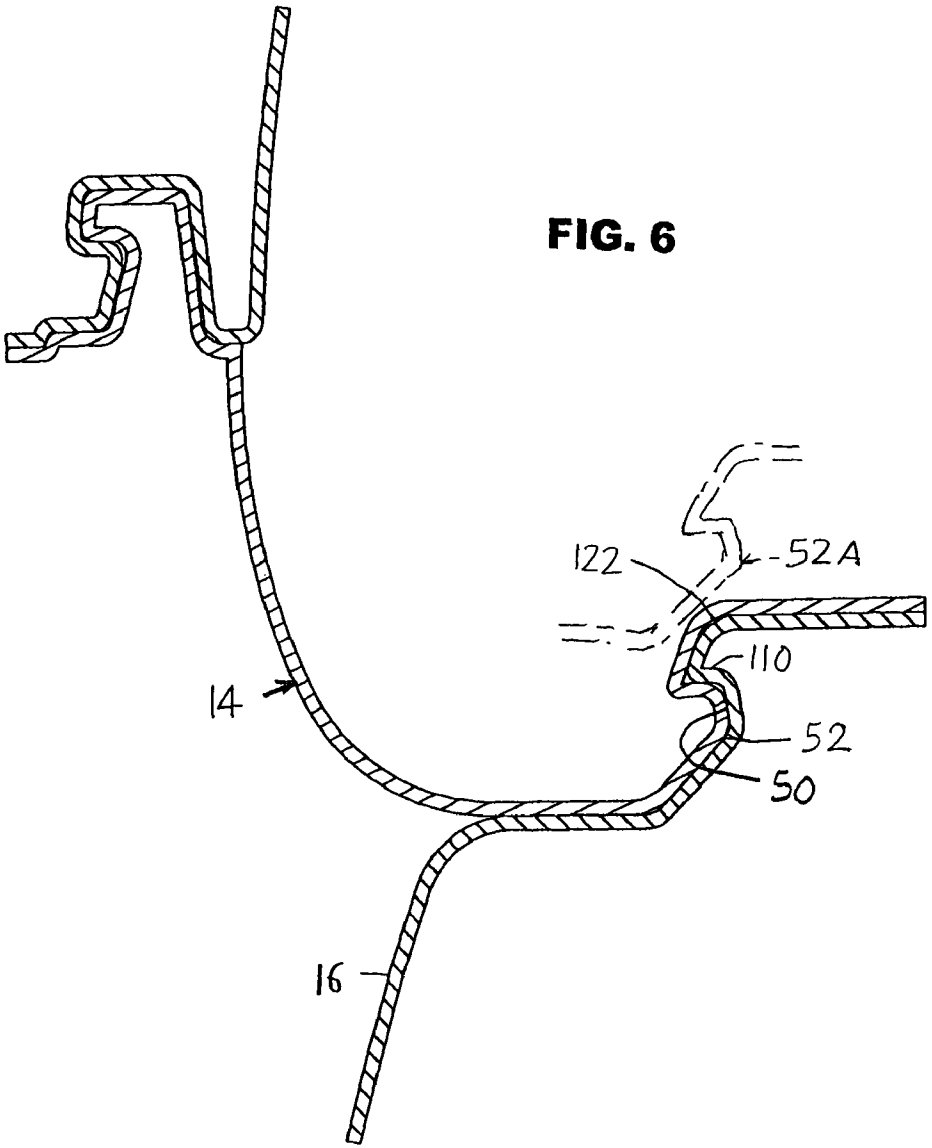
FIG. 6 is a sectional view taken on line A-A of FIG. 5.

As discussed above, a pair of identical containers of the type shown in FIG. 1, can be stacked by inserting the upward protrusion 40 of the cover element of the lower container into the upward receptacle 44 of the base element of the higher container for the purpose of aligning the elements. The protrusion initially may fit only partially in the receptacle. One of the containers is then turned by about 15° to 30° to a position to slide each projection 52 down into a vertical passage 120 and then into a corresponding groove 50. FIG. 6 shows that each groove 50 is vertically undercut, in that the groove walls include a top groove wall 110 that lies over the projection 52, so that once a projection 52 slides into a groove the projection cannot be pulled upward out of the groove.

One way to assemble a pair of containers into a stack is to align them and then move down the base 14 (FIG. 1) of a container onto a cover 16 of a next lower container, so each of a plurality of projections 52 moves down along a vertical passage 120 to the bottom of the passage. An adjacent groove 50 connects to the bottom of the passage, so the upper container and its base then can be turned so the projections 52 slide into the undercut grooves and then lie completely within a groove. The reverse manipulation is performed to separate a pair of stacked containers. That is, to separate a pair of container, one of the containers is pivoted about the axis 12 until the projection 52 in the base of that connector is aligned with a vertical passage 120 in the cover, and the cover is then lifted off the base.

The above described method to connect a pair of containers, by aligning projections with vertical passages to move down the projections and then turn one of the containers, can be avoided for faster latchable stacking. Such faster stacking can be accomplished by positioning the receptacle 44 of one container so its projections 52 lie directly over the grooves 50 of the other container. It is usually desirable to first align the containers so their center planes 66, 67 are coincident and their opposite sides 24, 32 lie one over the other, and then forcefully push down the upper container. As shown in FIG. 6, during downward movement of the base 14, each projections at 52A is deflected outward so it rides over beveled walls 122 that form one of the top walls of the undercut groove 50. The ability to latchably stack containers by merely forcefully pushing them down, is valuable in saving time, especially in a facility where a large number of stacks of containers must be prepared. The unstacking of the stack of containers requires that one of the elements such as the base element be turned to align its projections with the vertical passages 120 (FIG. 1) for easy lifting of the base away from the cover that lies below it.

Although applicant shows the upward protrusion 40 of the cover and the upward receptacle 44 of the base as both having end walls 42, 46 curved about the vertical axis 12 of the container, it is only necessary that one of them be curved, and that the other one fit closely in the curved part.

The base and cover of the same container are latched together by inward (projecting partially towards the axis 12, FIG. 1) projections 130 of the cover that move downward over beveled walls 132 on the base and then snap into vertically undercut grooves or recesses 134 in the base. This provides robust attachment of the base to the cover. To unlatch the base from the cover, a person pulls up a projecting corner tab 136 of the inner rim part of the cover, with considerable force (usually at least 5 pounds upward force).

FIGS. 12-19 show another container 140 with a vertical axis 142, wherein one of the container elements such as the cover element 144 has a plurality of linear vertically undercut grooves 146. The grooves extend in longitudinal M horizontal linear directions while the axis extends vertically. The grooves are formed in pads 150 that extend vertically upward from a top stacking wall 152 of the cover. The base element 160 has a plurality of lateral L projections 162 that fit into the grooves by sliding one element along one of the longitudinal directions M so the projections slide into the grooves.

Figure 16:
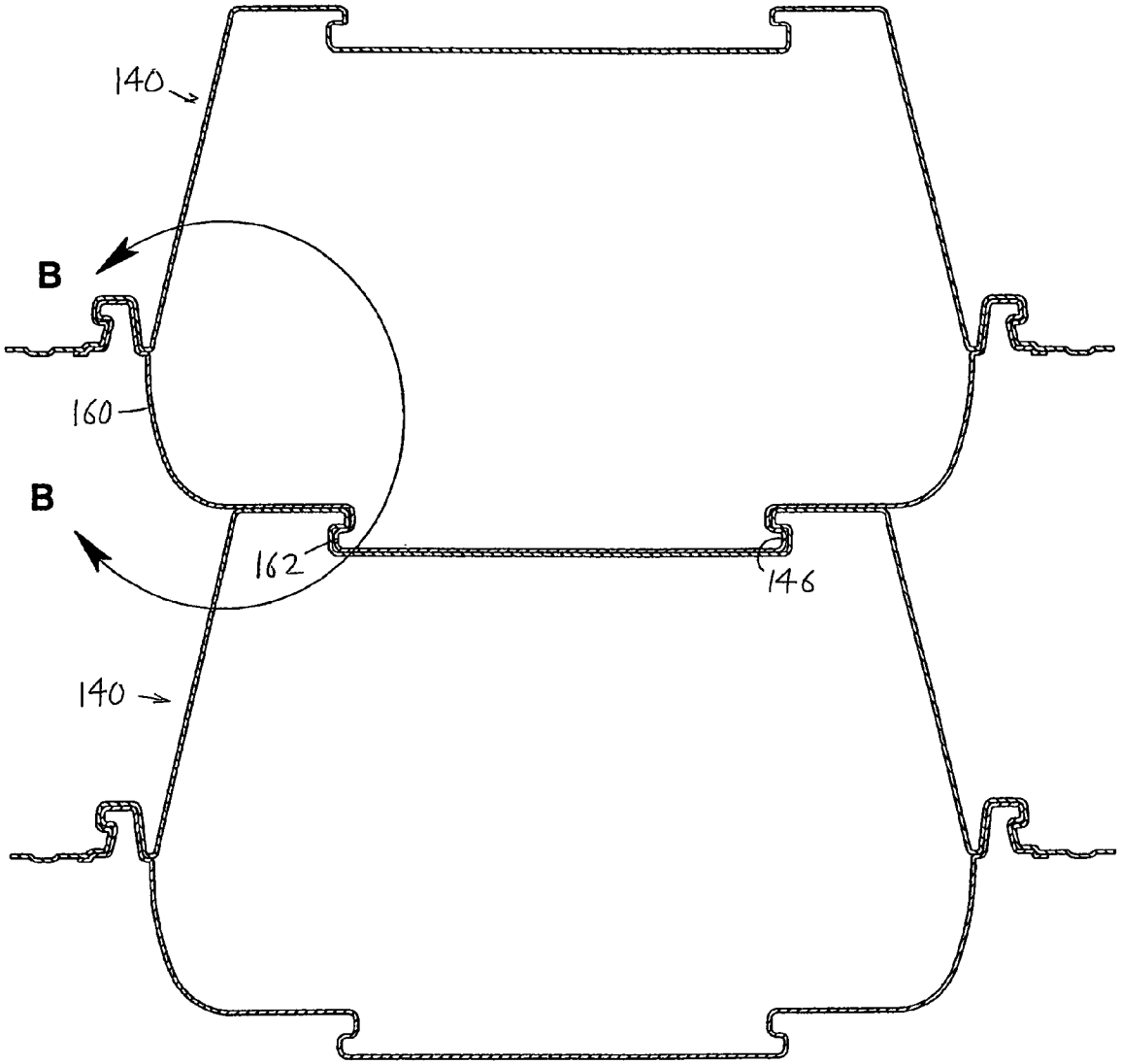
FIG. 16 is a sectional view taken on line A-A of FIG. 15.
Figure 17:
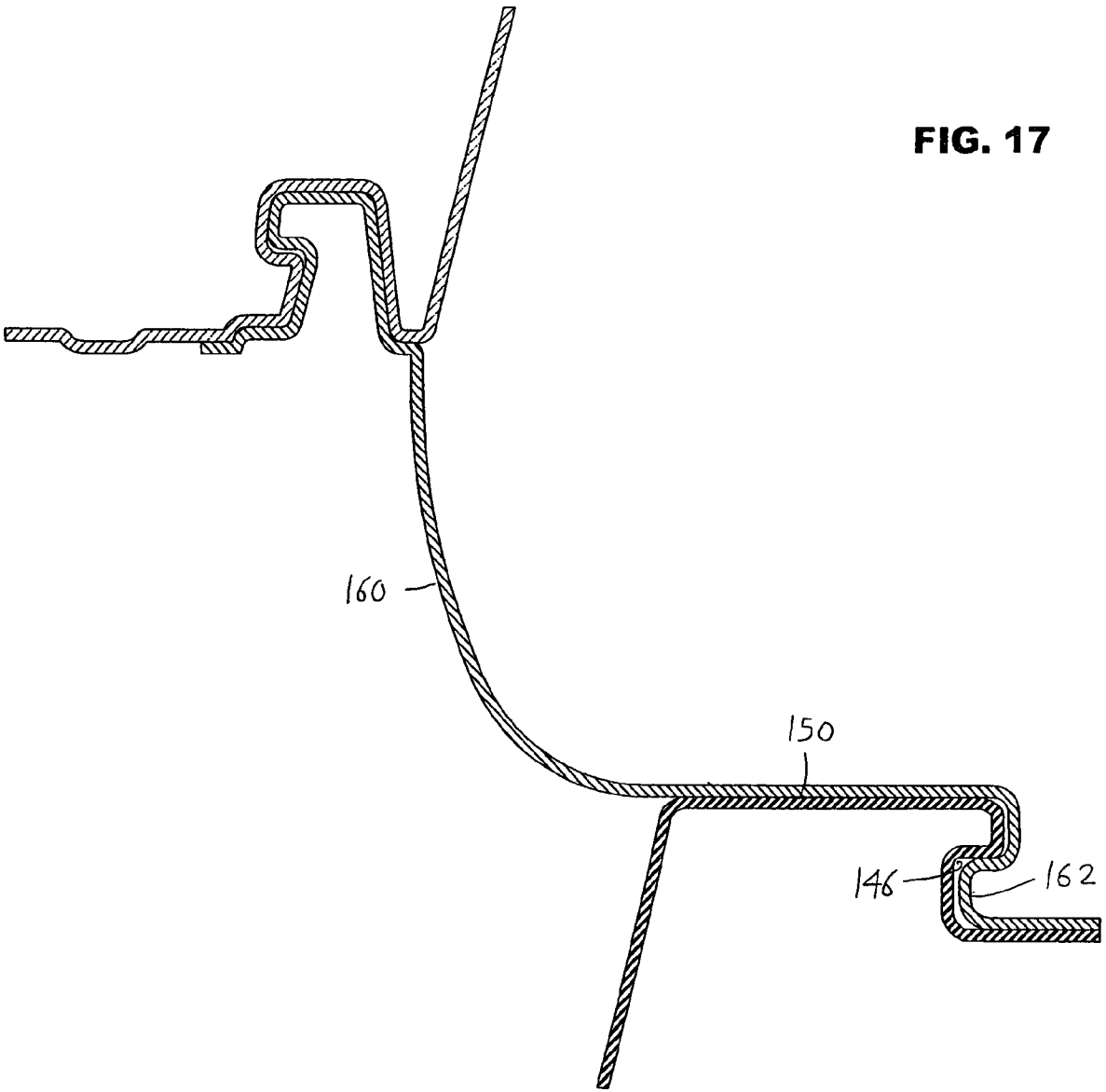
FIG. 17 is a sectional view of area B-B of FIG. 16.
Figure 18:
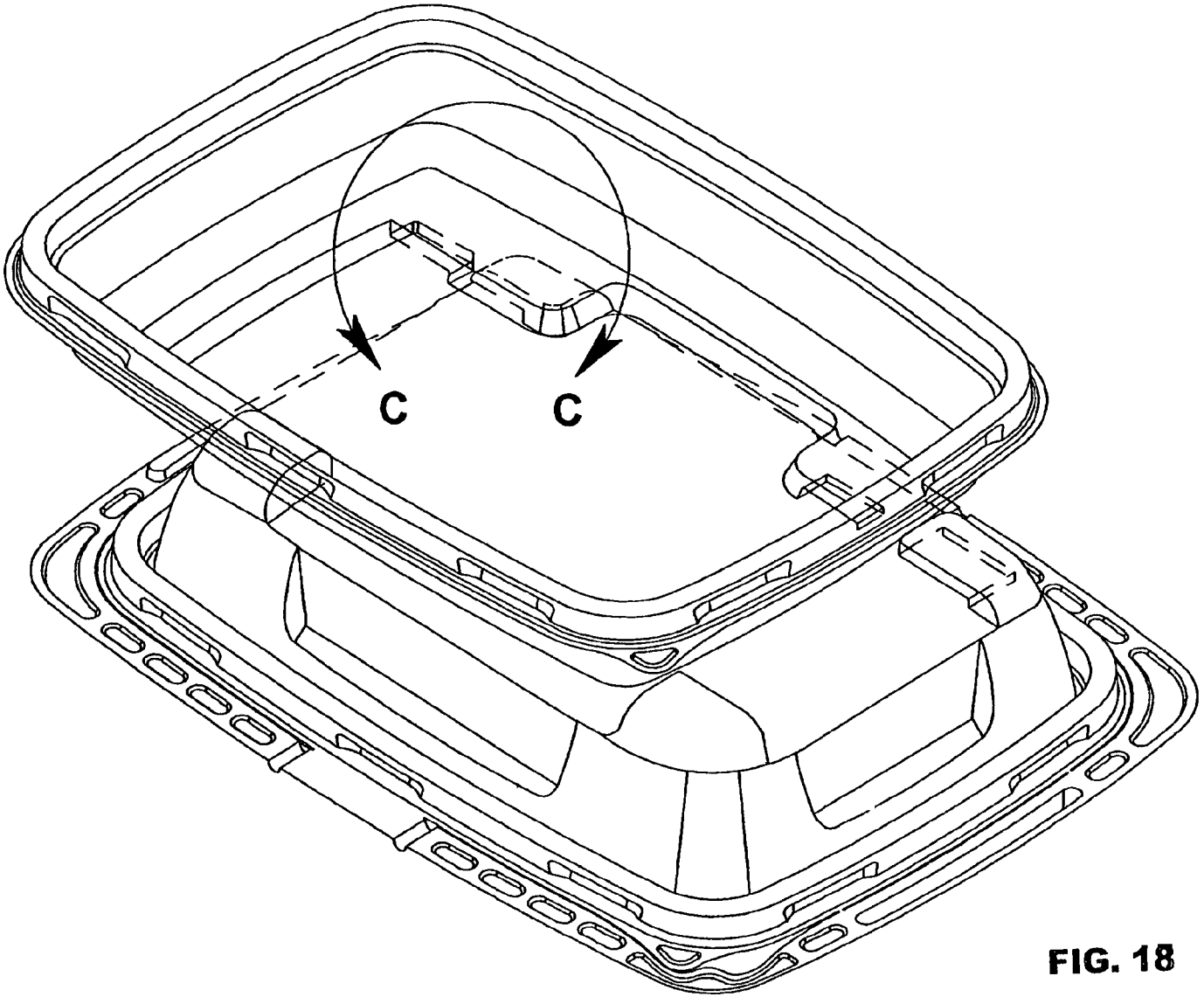
FIG. 18 is an exploded view showing a base of an upper container of the construction of FIG. 12, as it is positioned to latchably stack to the lid of a lower container of the construction of FIG. 12.
Figure 19:
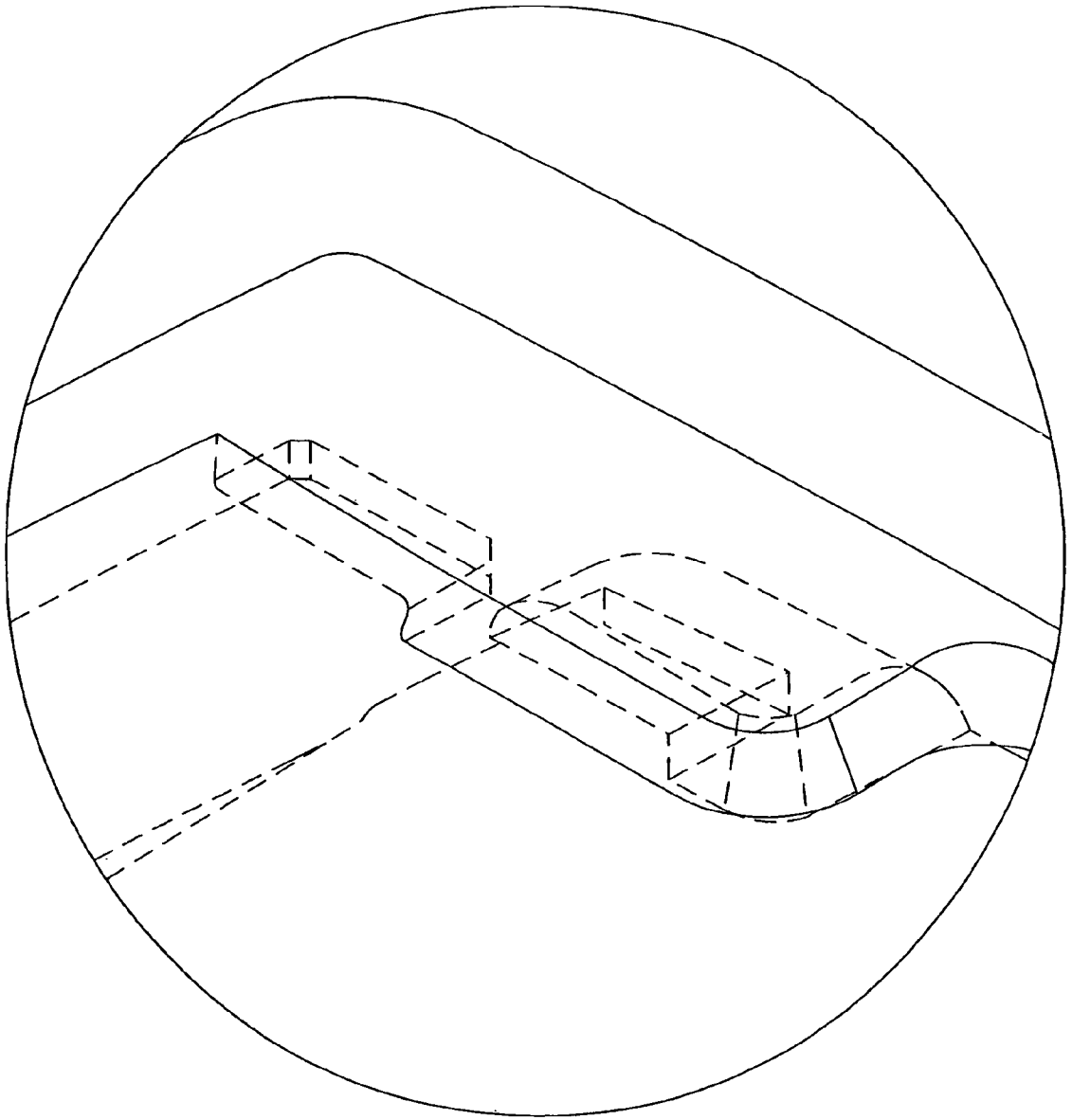
FIG. 19 is an enlarged isometric view of area C-C of FIG. 18.
Figure 20:
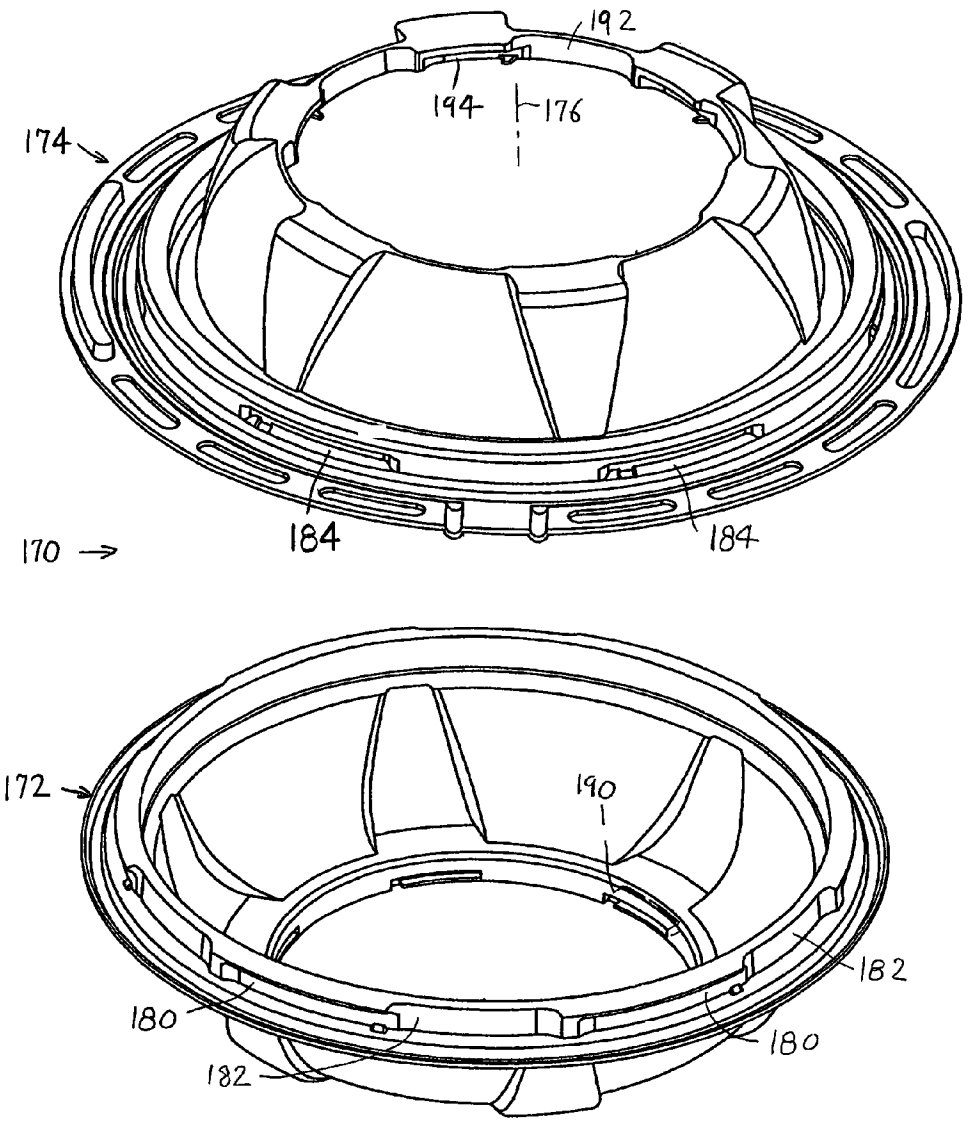
FIG. 20 is an exploded isometric view of a container of another embodiment of the invention, wherein the container has a round periphery.
Figure 21:
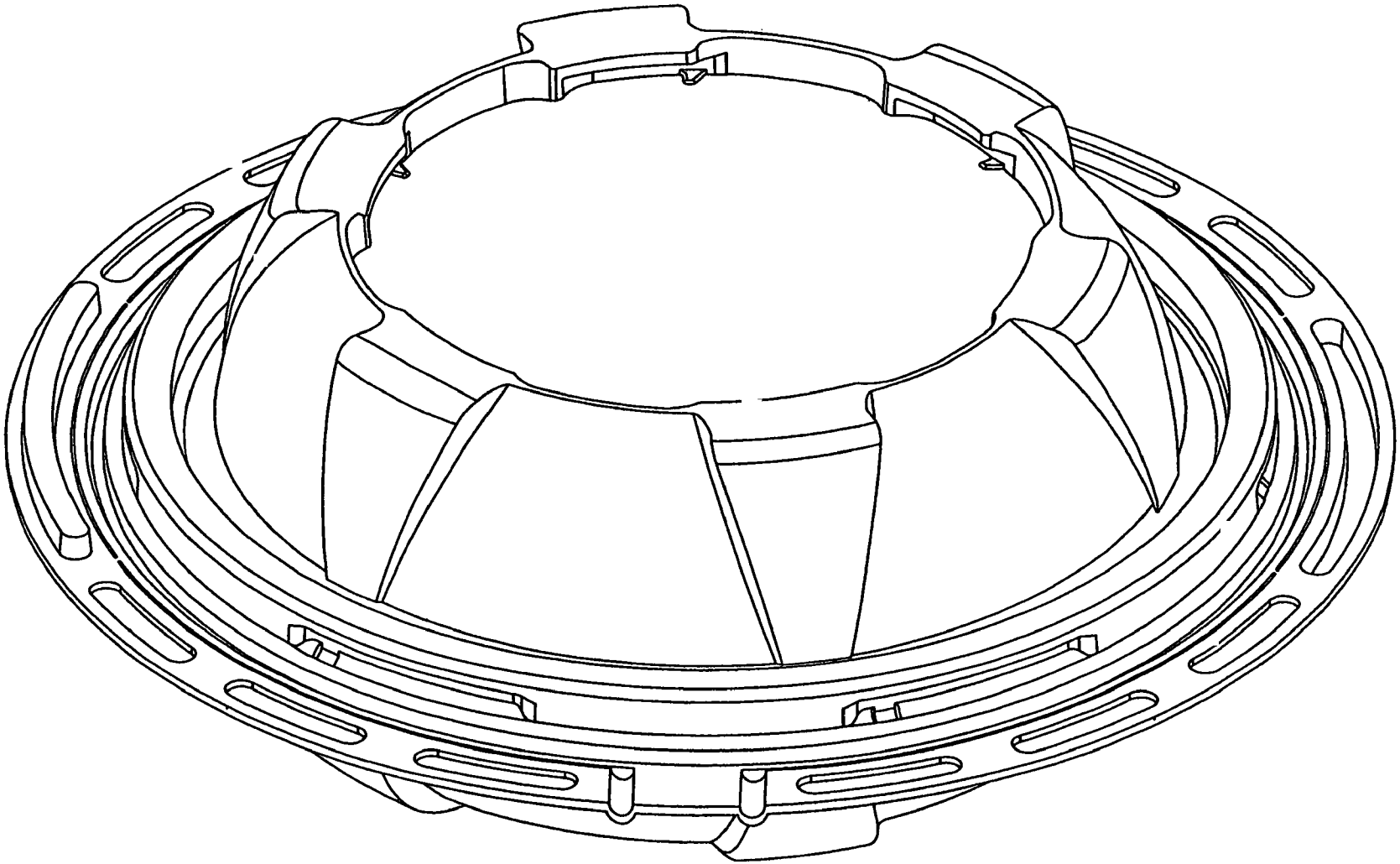
FIG. 21 is an isometric view of the container of FIG. 20 is a closed position.
Figure 22:
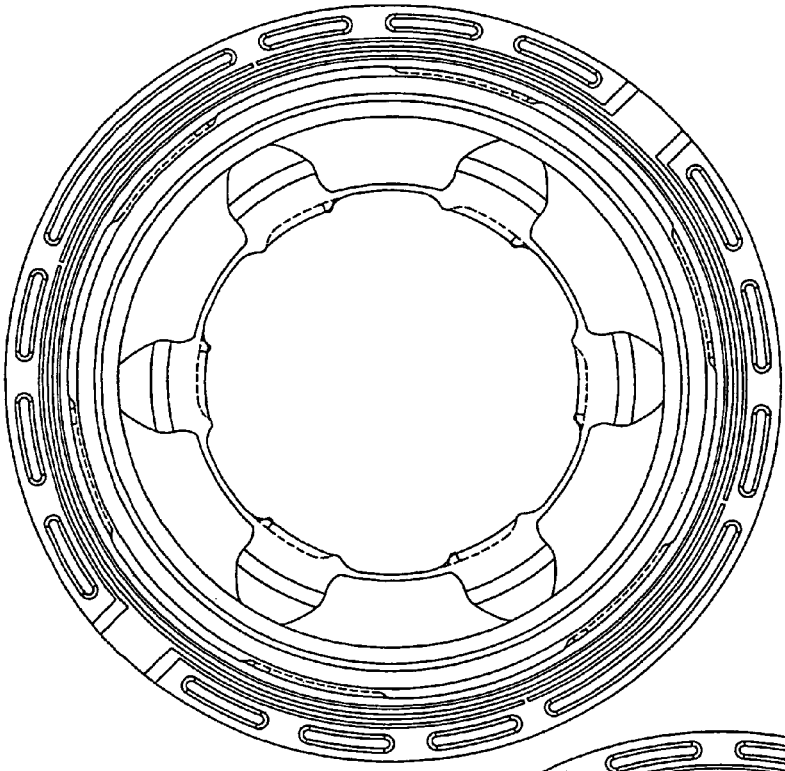
FIG. 22 is a plan view of the container of FIG. 21.
Figure 23:
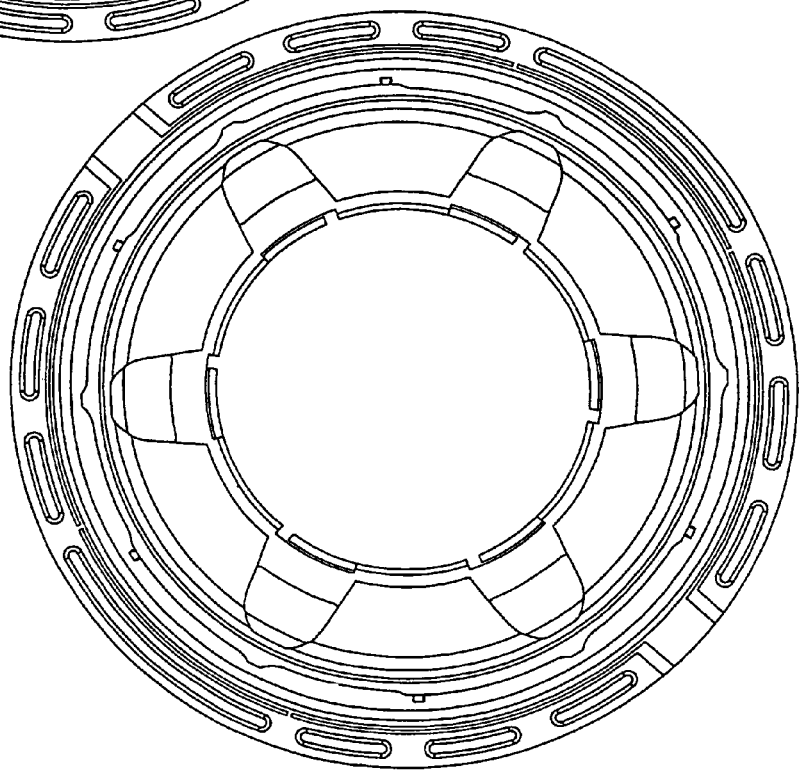
FIG. 23 is a bottom view of the container of FIG. 21.
Figure 24:
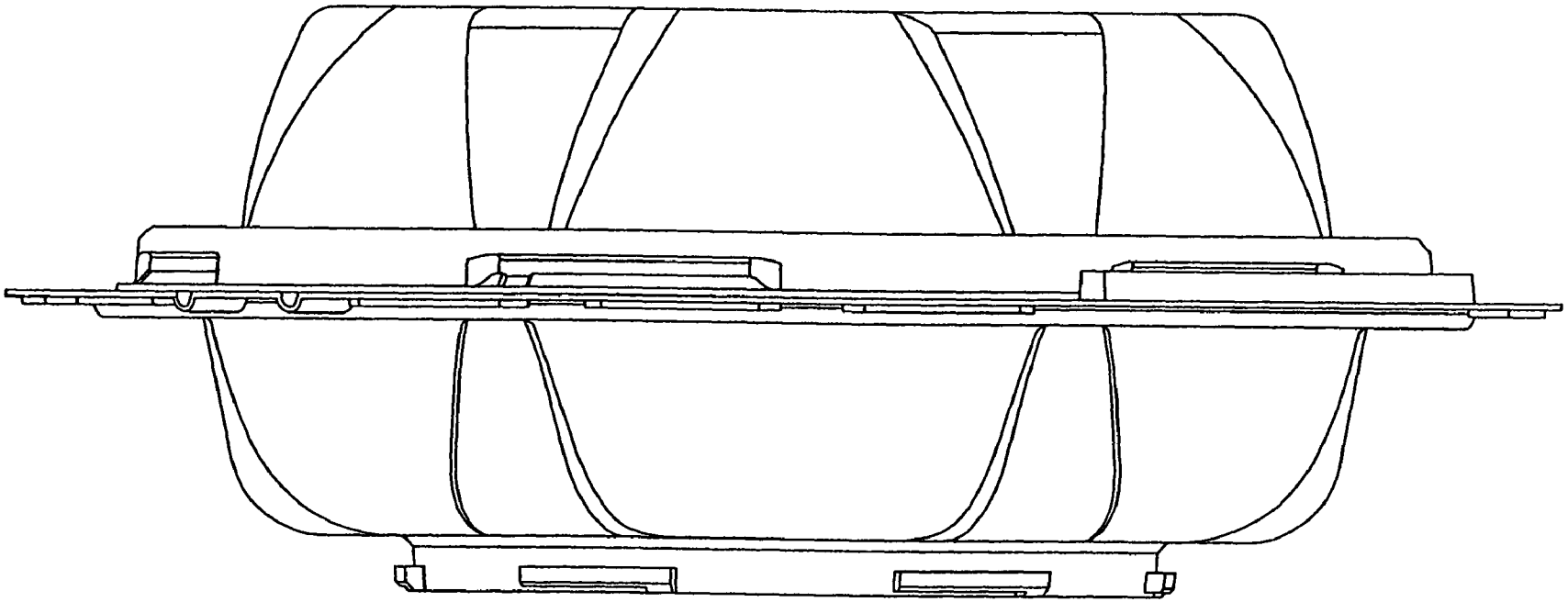
FIG. 24 is a front elevation view of the container of FIG. 21.
Figure 25:
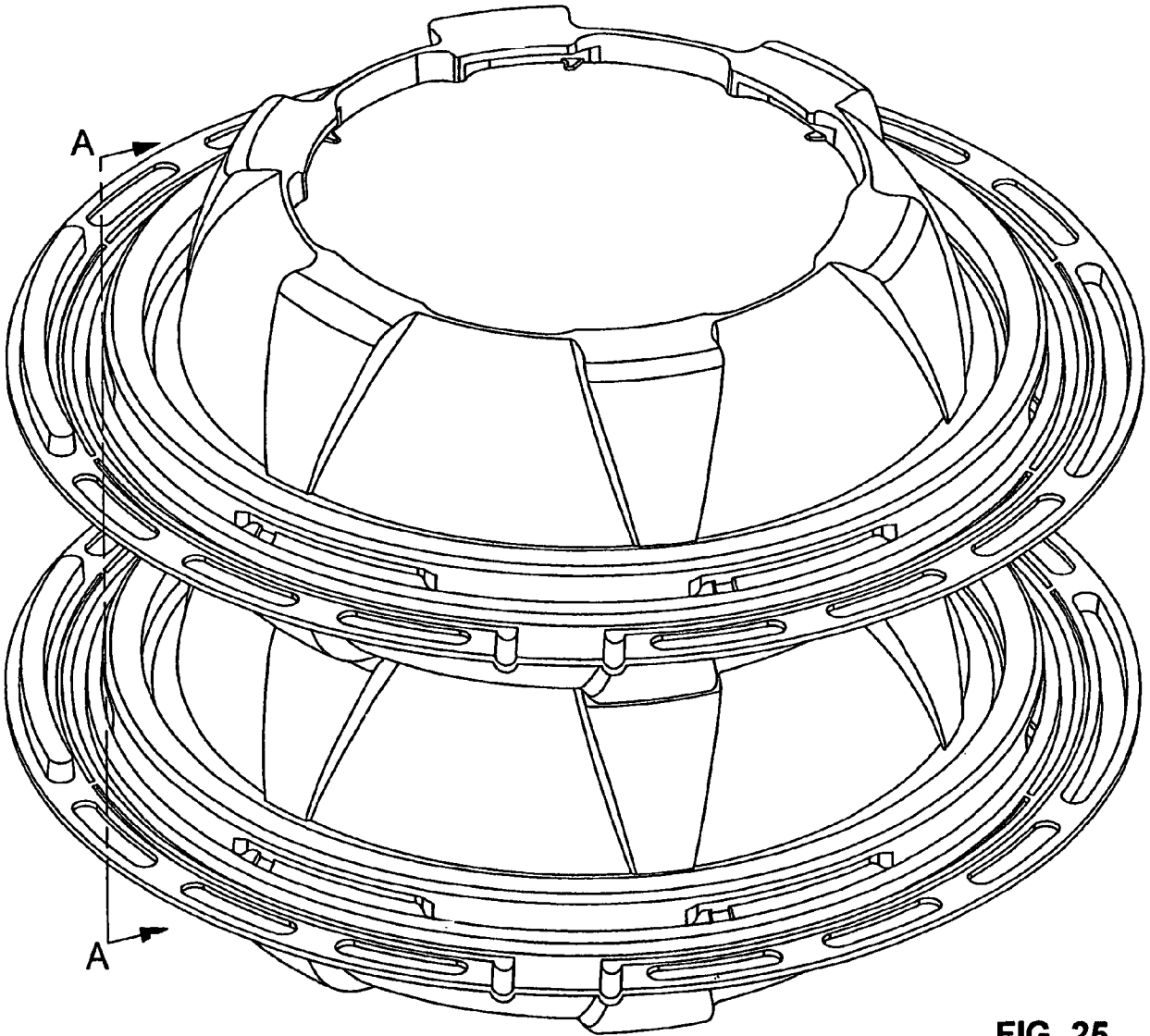
FIG. 25 is an isometric view of a stack of containers of the construction of FIG. 20.
Figure 26:
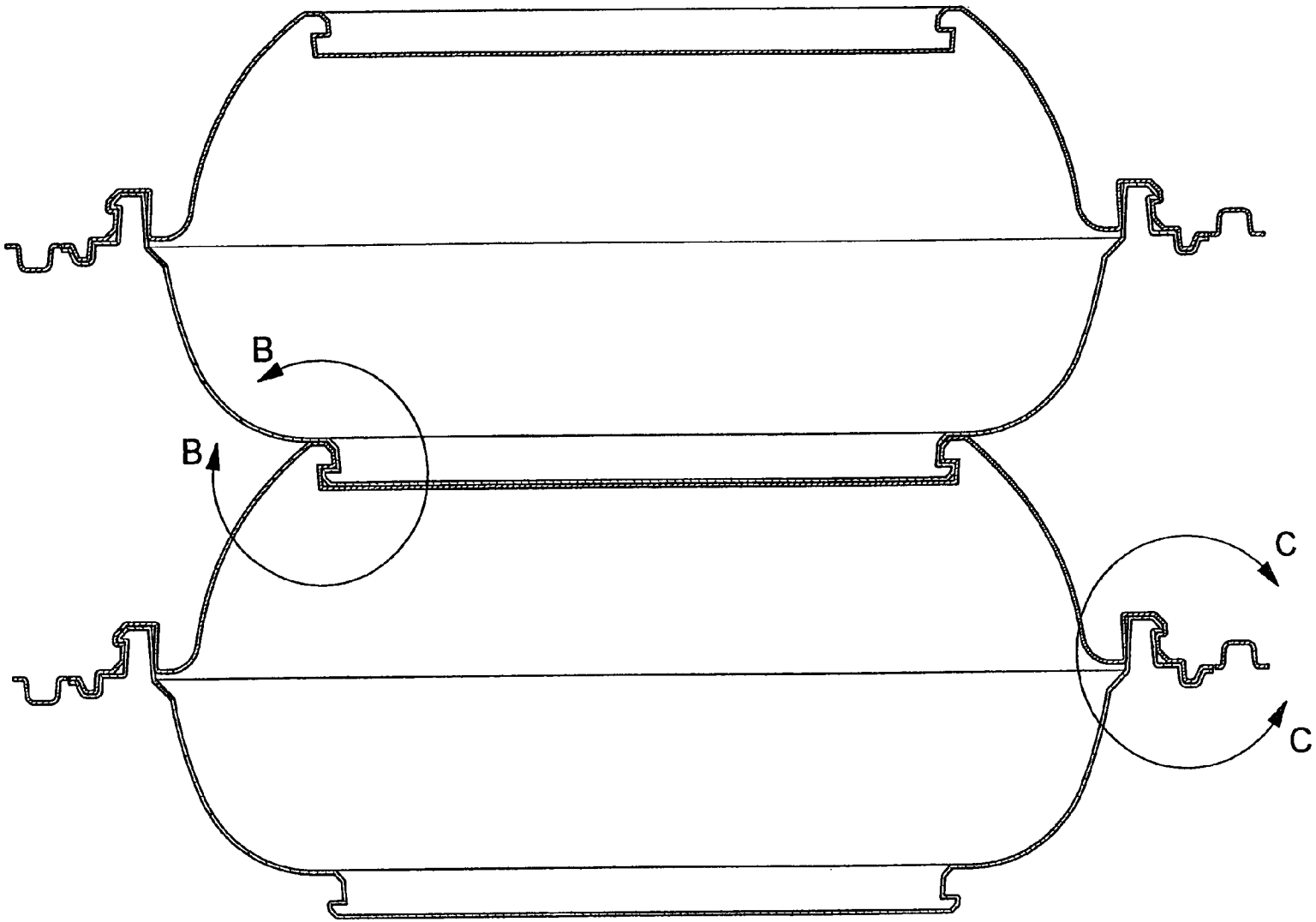
FIG. 26 is a sectional view taken on line A-A of FIG. 25.
Figure 27:
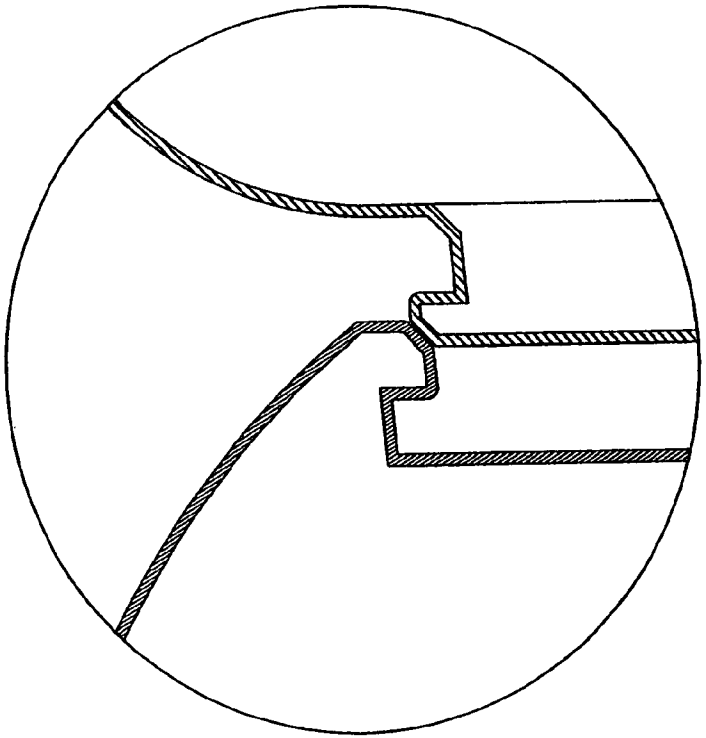
FIG. 27 is a sectional view taken on line B-B of FIG. 26, as the containers are being connected by forcefully pushing down the upper container onto the lower one.
Figure 28:
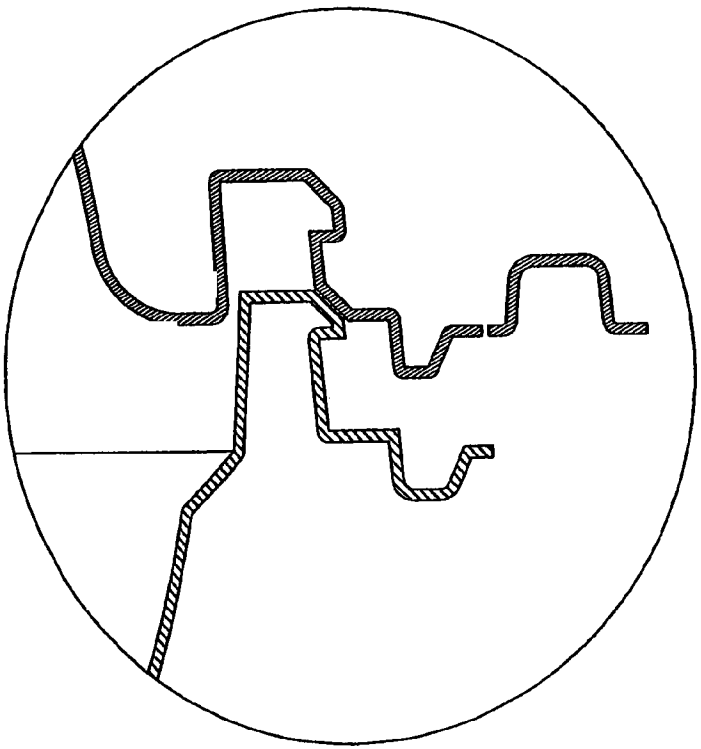
FIG. 28 is a sectional view taken on line C-C of FIG. 26, showing how the lid of a container is connected to the base of the container by forcefully pushing down the lid.
Figure 28A:
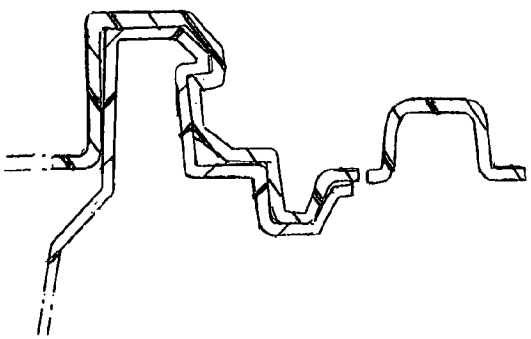
FIG. 28A is similar to FIG. 28, but after the lid and container are connected.

The pads 150 on the top of the cover walls form guiding walls 164, while the base forms guided walls 166 that move along the guiding walls that guide the horizontal projections into the vertically undercut grooves. FIG. 16 shows a pair of identical containers 140 with the base 160 of the upper container forming projections 162 that lie in grooves 146, as also shown in FIG. 17. The base and cover elements are latched together in a way that is similar to that of the container of FIG. 1-11.

FIGS. 20-29 show round containers 170, that is, containers formed by base and cover elements 172, 174 that have round rims curved about a vertical axis 176. For connecting the cover to the base, the base has vertically undercut grooves 180 and has vertical passages 182 with passage bottoms that lead to the grooves. The cover has projections 184 that can move down through the vertical passages, with one of the elements turned to then slide the projections into the grooves.

Figure 29:
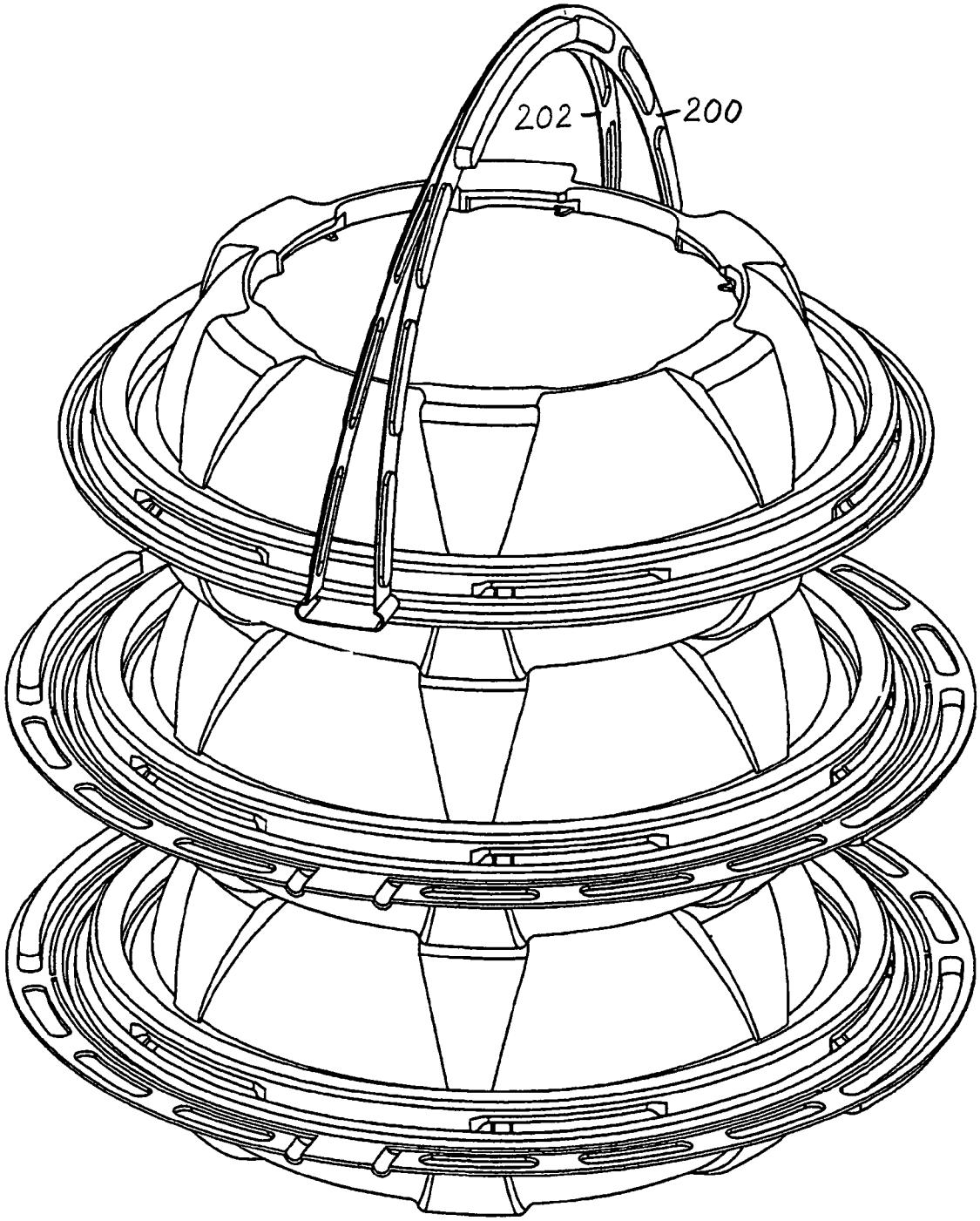
FIG. 29 is an isometric view of three containers shown latchably stacked, and with a handle assembly of the upper container deployed.

When the base 172 is an element of an upper container of a stack, and the cover 174 is an element 174 of the lower container of the stack, projections 190 of the base element can slide down along vertical passages 192 of the cover, and one of the elements can be turned to slide the projections into vertically undercut grooves 194 of the cover. The base of an upper container can be quickly connected to the cover of a next lower container by forcefully pushing down the upper container, in the same manner described above. As shown in FIG. 29, each container can form handles or handle sections 200, 202 that join to form a handle assembly.

Thus, the invention provides containers that can be latchably stacked, and provides containers that have handles that allow a single container or stack of containers to be easily carried without subsequent annoyance when a person eats out of the container base. A container with handle assembly has long thin handle sections formed in the cover of the container rather than in the base, and uses a robust attachment of the cover to the base. Containers that can be latchably stacked have base and cover elements, with one element having vertically undercut groove walls and the other having horizontal projections that are slide able into the grooves. The element with grooves preferably has vertical passages with the bottom (or possibly the top) of each passage leading to one end of a vertically undercut groove, so a projection can move vertically along a passage and then horizontally along a groove. Some containers can be rapidly latched together by forcefully pushing down one container onto another one so the projections move along a beveled surface directly into a groove. One element of an upper container forms a large downwardly-opening receptacle, and an element of the lower container forms an upward protrusion that fits into the receptacle, with walls the elements being circularly curved about a vertical axis of the containers. Another container has linear grooves that receive projections by sliding one container linearly on the other.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A plastic food container formed of sheet plastic having a vertical axis and comprising a base element having a base cavity for holding food and for eating food directly out of the base cavity and a base rim portion that surrounds a top of said base cavity, and a cover element lying over a middle of said cavity and having a cover rim portion that is securely latchable to said base rim portion to hold said container closed, wherein:

the rim portion of said cover element has a radially inner rim part, a radially outer rim part, and radially opposite sides forming a pair of connectors that each connects said radially inner and outer rim parts, said connectors each having circumferentially opposite ends that form pivot joints, and said radially outer rim part forming a pair of elongated handle sections that each extends from a pivot joint of a first of said connectors to a pivot joint of the other connector with said handle sections and inner rim part forming separation lines along which each handle section is separable from an adjacent portion of said radially inner part, each handle section pivoting on a pair of said pivot joints when lifted to thereby form a handle assembly;

wherein said connectors each defines a plane and said pivot joints each has a non-linear extent extending beyond the plane of an adjacent one of said connectors, and wherein one end of each pivot joint is integral with the connector, and the non-linear extent is separable along one of said separation lines from an adjacent one of said radially inner rim parts.

2. The container described in claim 1 wherein:

each of said pivot joints has a length of at least 1.5 millimeters.

3. The container described in claim 1 wherein:

said non-linear extent is a loop.

4. The container described in claim 1 wherein:

each of said handle sections has a handle middle that lies halfway between said connectors and that lies at the upper end of a corresponding handle section when the handle section has been lifted, said handle middles being horizontally spaced a distance when said handle sections are not lifted;

each of said connectors has a connector length; and the ratio of said connector length to said distance between said handle middles is no more than 25%.

5. The container described in claim 1 wherein:

said sheet plastic has a plastic thickness and said pivot joints each has a length of at least four times said plastic thickness.

6. A plastic food container folined of sheet plastic having a vertical axis and comprising a base element and a cover element, wherein a first of said base or cover elements has a rim portion comprising a radially inner rim part, a radially outer rim part, and radially opposite sides forming a pair of connectors that each connects said radially inner and outer rim parts, said connectors each having circumferentially opposite ends that form pivot joints, and said radially outer rim part forming a pair of elongated handle sections that each extends from a pivot joint of a first of said connectors to a pivot joint of the other connector, said handle sections and inner rim part forming separation lines along which each handle section is separable from an adjacent portion of said radially inner part, each handle section pivoting on a pair of said pivot joints when lifted to thereby form a handle, and wherein:

said sheet plastic has a plastic thickness and said pivot joints each has a length of at least four times said plastic thickness, said pivot joints each is integral with a corresponding one of the connectors and with a corresponding handle section, and wherein said connectors each defines a plane and said pivot joints each has a non-linear extent extending beyond the plane of an adjacent one of said connectors, said non-linear extent being a loop.

7. The container described in claim 6 wherein:

said first of said base or cover elements is said cover element.

8. A plastic food container formed of sheet plastic having a vertical axis and comprising a base element having a base cavity for holding food and for eating food directly out of the base cavity and a base rim portion that surrounds a top of said base cavity, and a cover element lying over a middle of said cavity and having a cover rim portion that is securely latchable to said base rim portion to hold said container closed, wherein:

the rim portion of said cover element has a radially inner rim part, a radially outer rim part, and radially opposite sides forming a pair of connectors that each connects said radially inner and outer rim parts, said connectors each having circumferentially opposite ends that form pivot joints, and said radially outer rim part forming a pair of elongated handle sections that each extends from a pivot joint of a first of said connectors to a pivot joint of the other connector with said handle sections and inner rim part forming separation lines along which each handle section is separable from an adjacent portion of said radially inner part, each handle section pivoting on a pair of said pivot joints when lifted to thereby form a handle assembly;

wherein said connectors each defines a plane and said pivot joints each has a non-linear extent extending beyond the plane of an adjacent one of said connectors, said non-linear extent being a loop.

9. The container described in claim 8 wherein:

said sheet plastic has a plastic thickness and said pivot joints each has a length of at least four times said plastic thickness.

10. The container described in claim 8 wherein:

each of said handle sections has a handle middle that lies halfway between said connectors and that lies at the upper end of a corresponding handle section when the handle section has been lifted, said handle middles being horizontally spaced a distance when said handle sections are not lifted;

each of said connectors has a connector length; and the ratio of said connector length to said distance between said handle middles is no more than 25%.

* * * * *